US007104640B2

(12) United States Patent
Ogura et al.

(10) Patent No.: US 7,104,640 B2
(45) Date of Patent: Sep. 12, 2006

(54) LIQUID CONTAINER, LIQUID USING DEVICE, PRINTING APPARATUS, AND METHOD OF MANUFACTURING LIQUID CONTAINER

(75) Inventors: Hideki Ogura, Kanagawa (JP); Ryoichi Matsumoto, Tokyo (JP); Ryoji Inoue, Kanagawa (JP); Tatsuo Nanjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 212 days.

(21) Appl. No.: 10/808,477

(22) Filed: Mar. 25, 2004

(65) Prior Publication Data

US 2004/0196341 A1 Oct. 7, 2004

(30) Foreign Application Priority Data

Apr. 4, 2003 (JP) ..... 2003-102071
Mar. 4, 2004 (JP) ..... 2004-061418

(51) Int. Cl.
*B41J 2/175* (2006.01)

(52) U.S. Cl. ..... 347/86; 347/87

(58) Field of Classification Search ..... 347/85, 347/86, 87

See application file for complete search history.

(56) References Cited

U.S. PATENT DOCUMENTS

| | | | | |
|---|---|---|---|---|
| 4,509,062 | A | 4/1985 | Low et al. | 443/973 |
| 5,600,358 | A | 2/1997 | Baldwin et al. | 347/87 |
| 5,917,523 | A | 6/1999 | Baldwin et al. | 347/85 |
| 6,540,341 | B1 * | 4/2003 | Hsieh et al. | 347/86 |
| 6,773,099 | B1 * | 8/2004 | Inoue et al. | 347/86 |
| 6,837,575 | B1 * | 1/2005 | Usui | 347/85 |
| 6,854,836 | B1 * | 2/2005 | Ishinaga et al. | 347/85 |
| 6,976,753 | B1 * | 12/2005 | Kuwabara et al. | 347/86 |
| 2002/0135646 | A1 | 9/2002 | Minora | 347/85 |
| 2003/0035036 | A1 | 2/2003 | Ogura et al. | 347/86 |
| 2003/0067518 | A1 | 4/2003 | Ishinaga et al. | 347/85 |
| 2003/0122909 | A1 | 7/2003 | Ogura et al. | 347/86 |
| 2004/0061748 | A1 | 4/2004 | Kuwabara et al. | 347/85 |
| 2004/0090510 | A1 | 5/2004 | Inoue et al. | 347/104 |
| 2004/0135854 | A1 | 7/2004 | Kuwabara et al. | 347/85 |
| 2004/0196340 | A1 | 10/2004 | Inoue et al. | 347/86 |

FOREIGN PATENT DOCUMENTS

| | | | | |
|---|---|---|---|---|
| JP | 55073564 | * | 6/1980 | 347/93 |
| JP | 6-183023 | | 7/1994 | |
| JP | 2001270129 | * | 10/2001 | |

* cited by examiner

*Primary Examiner*—Ahn T. N. Vo
(74) *Attorney, Agent, or Firm*—Fitzpatrick, Cella, Harper & Scinto

(57) ABSTRACT

This invention provides a liquid container capable of stably supplying a liquid contained therein, a liquid using device, a printing apparatus, and a method of manufacturing the liquid container. In one preferred embodiment of this invention, a one-way valve used in an ink tank is constructed of a flexible sheet. In an area of the flexible sheet, an undulated portion is formed whose undulated form is maintained in an operation range of the one-way valve.

9 Claims, 22 Drawing Sheets

LIQUID CONTAINER, LIQUID USING DEVICE, PRINTING APPARATUS, AND METHOD OF MANUFACTURING LIQUID CONTAINER

This application claims priority from Japanese Patent Application Nos. 2003-102071 filed Apr. 4, 2003 and 2004-061418 filed Mar. 4, 2004, which are incorporated hereinto by reference.

BACKGROUND OF THE INVENTION

1. Field of the Invention

The present invention relates to a liquid container capable of stably supplying a liquid such as ink contained therein, a liquid using device, a printing apparatus, and a method of manufacturing the liquid container.

2. Description of the Related Art

An ink tank for directly supplying ink to a print head capable of ejecting ink has a negative pressure generation mechanism that generates a negative pressure to be applied to the ink. The negative pressure generated by the negative pressure generation mechanism is set in an appropriate range that is large enough to balance with a retaining force of an ink meniscus formed at ink ejection portions in the print head to prevent leakage of ink from the ink ejection portions and which also allows ink ejections from the print head.

Such a negative pressure generation mechanism is formed, for example, by installing in an ink tank a porous material such as sponge capable of soaking and holding ink and generates an appropriate negative pressure by an ink retaining force of the porous material. Another example of the negative pressure generation mechanism has a bag-like member formed of an elastic material such as rubber capable of producing a tensile force that tends to expand a volume of the bag. The bag-like member is filled with ink and, through its tensile force, applies a negative pressure to the ink. Still another example has a bag-like member formed of a flexible film and engages a spring with an interior or exterior of the bag-like member to urge the flexible film in a direction that expands the volume of the bag, thereby applying a negative pressure to the ink in the bag-like member.

With these negative pressure generation mechanisms, however, the negative pressure generated tends to increase as the amount of ink remaining in an ink tank (bag-like member) decreases. When the negative pressure exceeds a predetermined level, ink can no longer be supplied stably to a print head. This gives rise to a possibility of the ink tank becoming unfit for use before the ink in the ink tank is completely consumed.

This is explained in the following example. U.S. Pat. No. 4,509,062 discloses an ink tank which comprises a hermetically closed resilient bag member and a spring member installed in the bag member. The resilient bag member directly accommodates ink and is deformable according to the amount of ink contained therein. The spring member urges the bag member in a direction that expands its volume. With this ink tank, the negative pressure in the bag member is basically such as will balance with a spring force of the spring member. Thus, as the bag member deforms to reduce its volume to match the ongoing consumption of ink and the inner spring is compressed, the negative pressure in the bag member increases. As a result, the negative pressure may increase in excess of an appropriate range that allows normal ink ejections from a print head, making it impossible for an adequate meniscus to be formed at the ink ejection portions of the print head or to supply ink stably to the print head. In this case, not all of the ink volume in the bag member cannot be used.

There is also an ink tank which produces a negative pressure by taking advantage of an elasticity of an ink accommodating bag member itself whose material and shape are determined appropriately. The bag member is formed flat so that its inner space vanishes when the ink contained therein is completely used up. This kind of bag member, however, has a limitation on the shape. If an ink tank is constructed of a box-like case accommodating a bag member, the bag member even when loaded with ink does not assume a shape that perfectly fits in the case, degrading an ink accommodation efficiency with respect to an overall ink tank space. Even with this bag member, when the ink is about to be used up, the negative pressure is so high as will cause a performance degradation in supplying ink to the print head or make the ink ejection operation of the print head unstable.

To prevent the level of negative pressure generated by the negative pressure generation mechanism from exceeding a predetermined level, the following adjust mechanisms have been proposed.

For example, U.S. Pat. Nos. 5,917,523 and 5,600,358 disclose an adjust mechanism which has a ball arranged in a tube vent in an ink tank (container) so that when a negative pressure in the ink tank increases, air is taken into the ink tank to prevent a negative pressure increase. In this adjust mechanism, the tube vent (boss) communicating an interior of the ink tank with the outside has a plurality of protruding ribs formed on its inner wall. A ball with an outer diameter smaller than that of the boss is fitted inside the boss so that it is in contact with the protruding ribs. As a result, a roughly ring-shaped orifice is formed between the ball and the boss. A size of this orifice is so set that a small amount of ink is held as a liquid seal in the orifice by its capillary attraction. When the negative pressure in the ink tank approaches an allowable limit of the operation range of the print head, the negative pressure overcomes the ink capillary attraction in the orifice, breaking the liquid seal and allowing air to enter into the ink tank through the orifice.

Japanese Patent Application Laid-open No. 6-183023 (1994) describes another adjust mechanism for preventing a negative pressure rise. This adjust mechanism is used in a negative pressure generation mechanism which comprises a plate with a hole and a plate with a protrusion, both arranged to face each other in an ink bag of resilient sheet, and a spring member arranged between these plates. When the ink bag contracts as a result of a reduction in the remaining volume of ink and the inner negative pressure exceeds a predetermined value, the adjust mechanism causes the protrusion of one plate to fit into the hole of the other plate, thus separating the holed plate from the resilient sheet to allow air to be introduced into the ink bag. With this adjust mechanism, after air is drawn into the ink bag, the holed plate and the resilient sheet are brought into intimate contact with each other, preventing an ink leakage by an ink meniscus retaining force or a liquid seal between them.

These negative pressure adjust mechanisms disclosed in U.S. Pat. Nos. 5,917,523, 5,600,358 and Japanese Patent Application Laid-open No. 6-183023 (1994), however, all require a plurality of parts in the air take-in portion, rendering the construction that much complicated.

The adjust mechanism disclosed in U.S. Pat. Nos. 5,917,523 and 5,600,358 forms a hermetically closed system as an ink accommodation space through a balance between an ink meniscus force (liquid seal) in a ring-shaped orifice and a negative pressure produced by a spring. Although the mechanical construction is relatively simple, this adjust mechanism lacks a stability in maintaining the hermetically closed system. That is, the liquid seal in the orifice may be broken depending on various conditions, resulting in a leakage of accommodated ink. The conditions that may cause an ink leakage include a pressure difference between the inside and outside of the ink tank, a reduction in ink viscosity due to temperature rise, an inadvertent impacts on or fall of the ink tank during handling, and an acceleration to which the ink tank is subjected during a main scan in a serial printing apparatus in which the ink tank is moved in the main scan direction along with the print head. The liquid seal is easily affected by humidity variations, such as dry atmosphere. The humidity variations therefore make an air introducing operation unstable, which in turn may lead to a performance reduction in supplying ink to the print head and to a degraded quality of printed images.

To eliminate these problems, the adjust mechanism disclosed in U.S. Pat. Nos. 5,917,523 and 5,600,358 provides an inlet maze connecting to an annular boss. The inlet maze is considered to function as an ink overflow container and secure a humidity gradient. The provision of the inlet maze, however, complicates the construction. Further, since the other end of the inlet maze (maze-like path) communicates with open air at all times, the ink unavoidably evaporates to some degree through this inlet maze.

There is another problem. When ink in the ink tank is used up, outer air rushes into the ink tank through the ring-shaped orifice to eliminate the negative pressure in the ink tank. At this time, the inrush air may cause the ink remaining in the print head and the ink tank to leak out of nozzles or through the ring-shaped orifice in which the meniscus has been broken.

Further, in the adjust mechanisms disclosed in U.S. Pat. Nos. 5,917,523, 5,600,358, and Japanese Patent Application Laid-open No. 6-183023 (1994), a liquid-sealed opening is provided in the ink container (i.e., an ink tank in U.S. Pat. Nos. 5,917,523 and 5,600,358; and an ink bag in Japanese Patent Application Laid-open No. 6-183023 (1994)) to directly, introduce the atmosphere. When ink in the ink container is almost running out and a volume of air in the ink container is larger than that of ink, if the atmosphere is introduced into the ink tank through the opening, the maintenance of a meniscus in the liquid-sealed opening of the container and in the ink nozzle openings of the print head may become incomplete. This in turn may cause an ink leakage and render the introduction of air incomplete. Depending on a variety of conditions the liquid seal in the opening may be broken, resulting in an early introduction of air before the pressure in the ink container reaches a predetermined value or, conversely, a leakage of ink. The conditions leading to unwanted air introduction or ink leakage include a pressure difference between the inside and outside of the ink container, temperature variations, impacts on and fall of the ink tank during handling, and an acceleration to which the ink tank is subjected during a main scan in a serial printing apparatus in which the ink tank is moved in the main scan direction along with the print head. These conditions change depending on the design of the print head and ink tank and a physical property of ink, so it is difficult to properly design a shape and dimensions of the opening.

The negative pressure adjust mechanisms using the liquid seal described above may also reduce a degree of freedom of design in the printing apparatus.

That is, it is difficult to form the liquid seal portion separate from the ink tank and then removably mount it on the ink tank. If the liquid seal portion is formed separate from the ink tank, when it is directly mounted on the ink tank or indirectly connected to the ink tank through a tube or the like, complex processing or a special construction considering a pressure difference between the inside and outside of the ink tank is required in order to form a good meniscus in the liquid seal portion. Where the liquid seal portion is provided remote from the ink tank and connected to it through a tube, the tube needs to be filled with ink in order to form a meniscus in the liquid seal portion. The introduction of air through the liquid seal portion forces the ink in the tube back into the ink tank. Refilling the tube with ink after the air introduction requires complicated processing or construction.

In the adjust mechanism disclosed in Japanese Patent Application Laid-open No. 6-183023 (1994), since air is introduced through a small clearance between a thin plate member and a flexible sheet, a capillary attraction produced by a liquid entering that clearance changes a force required to separate the holed plate and the flexible sheet. As a result, the negative pressure level at which the air introduction is executed may become unstable. Further, when a pressure of gas (air) in the ink bag increases as the temperature increases, the flexible sheet must be deformed to virtually increase the inner volume of the ink bag to alleviate the increasing inner pressure. Therefore, the flexible sheet member is formed of an easily deformable material with a very low stiffness.

However, low-rigidity materials used for such a flexible sheet generally have a small thickness and a high gas permeability, so air can easily pass through it. Thus, if ink is stored in the ink bag for a long period of time, a large volume of air, so large as cannot be dealt with by a buffer function originally intended to absorb an expanded portion of gas (air) in the ink bag, enters into the ink bag, rendering the buffer function ineffective. It is therefore necessary to use a very expensive material deposited with a metal vapor to meet both of the requirements of a low rigidity and a low gas permeability.

SUMMARY OF THE INVENTION

An object of this invention is to provide a liquid container capable of stably supplying a liquid such as ink contained therein, a liquid using device, a printing apparatus, and a method of manufacturing the liquid container.

In the first aspect of the present invention, there is provided a liquid container comprising:

an accommodation portion to define a liquid accommodation space;

a liquid supply portion to supply a liquid accommodated in the accommodation space to an outside;

a mechanism to maintain or expand a volume of the accommodation space; and a one-way valve to allow an introduction of a gas from the outside into the accommodation space and prevent the liquid and gas from flowing out of the accommodation space to the outside;

wherein the one-way valve includes: a flexible sheet situated between a first chamber on the accommodation space side and a second chamber on the outside and having an area to secure a predetermined level of freedom of deflection; and a valve mechanism to perform an open-close operation accompanied by a deflection of the flexible sheet, the degree of the flexible sheet deflection conforming to a pressure difference between the first chamber and the second chamber;

wherein the area of the flexible sheet is formed with an undulated portion whose undulated form is maintained in at least an operation range of the valve mechanism.

In the second aspect of the present invention, there is provided an ink tank accommodating ink as a liquid in the liquid container of the first aspect of the present invention.

In the third aspect of the present invention, there is provided an ink jet cartridge having the ink tank of the second aspect of the present invention and an ink jet print head to eject ink.

In the fourth aspect of the present invention, there is provided an ink jet printing apparatus for printing an image by using the ink tank of the second aspect of the present invention and an ink jet print head to eject ink and by ejecting ink supplied from the ink tank from the ink jet print head.

In the fifth aspect of the present invention, there is provided a one-way valve for allowing a fluid to move from a first chamber on one side of a path to a second chamber on the other side and blocking the fluid from moving from the second chamber to the first chamber, the one-way valve comprising:

a flexible sheet situated between the first chamber and the second chamber and having an area to secure a predetermined level of freedom of deflection; and a valve mechanism to perform an open-close operation accompanied by a deflection of the flexible sheet, the degree of the flexible sheet deflection conforming to a pressure difference between the first chamber and the second chamber;

wherein the area of the flexible sheet is formed with an undulated portion whose undulated form is maintained in at least an operation range of the valve mechanism.

In the sixth aspect of the present invention, there is provided a method of manufacturing a liquid container, wherein the liquid container includes: an accommodation portion to define a liquid accommodation space; a liquid supply portion to supply a liquid accommodated in the accommodation space to an outside; a mechanism to maintain or expand a volume of the accommodation space; and a one-way valve to allow an introduction of a gas from the outside into the accommodation space and prevent the liquid and gas from flowing out of the accommodation space to the outside;

wherein the one-way valve includes: a flexible sheet situated between a first chamber on the accommodation space side and a second chamber on the outside and having an area to secure a predetermined level of freedom of deflection; and a valve mechanism to perform an open-close operation accompanied by a deflection of the flexible sheet, the degree of the flexible sheet deflection conforming to a pressure difference between the first chamber and the second chamber;

the method comprising:

a step of, before or after the flexible sheet is assembled into the one-way valve, forming in the area of the flexible sheet an undulated portion whose undulated form is maintained in at least an operation range of the valve mechanism.

This invention is based on the following findings.

The inventors of this invention have found that, when introducing air into a liquid container to prevent a negative pressure rise in the container, it is not desirable to totally eliminate the negative pressure in the container but it is important to return the negative pressure to an original, predetermined level. To this end, it is also found that an appropriate volume of air needs to be introduced. Particularly when a liquid container is used as an ink tank for directly supplying ink to an ink jet print head, the supply of ink at a stable flow velocity and in a stable flow volume is essential in enhancing a printing speed and image quality. To realize this, it is strongly desired that a resistance that the ink generates as it flows through an ink supply path be kept almost constant. It is therefore important to stabilize the negative pressure in the ink tank and keep it in a predetermined range. This requires components that introduce air into the ink tank to operate reliably.

To minimize an ingress of gas into the container, it is important that a chance of the constitutional members of the container becoming subjected to a pressurized gas be reduced so that the liquid can be accommodated in the container in an appropriate condition and stably supplied from there.

In this invention a one-way valve installed in the liquid container is formed by using a flexible sheet. An undulated portion whose undulated form is maintained is formed in a movable area of the flexible sheet, so that the flexible sheet is deflected stably. In the result, the pressure in the liquid container is kept in a predetermined range and the liquid in the container is supplied stably.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
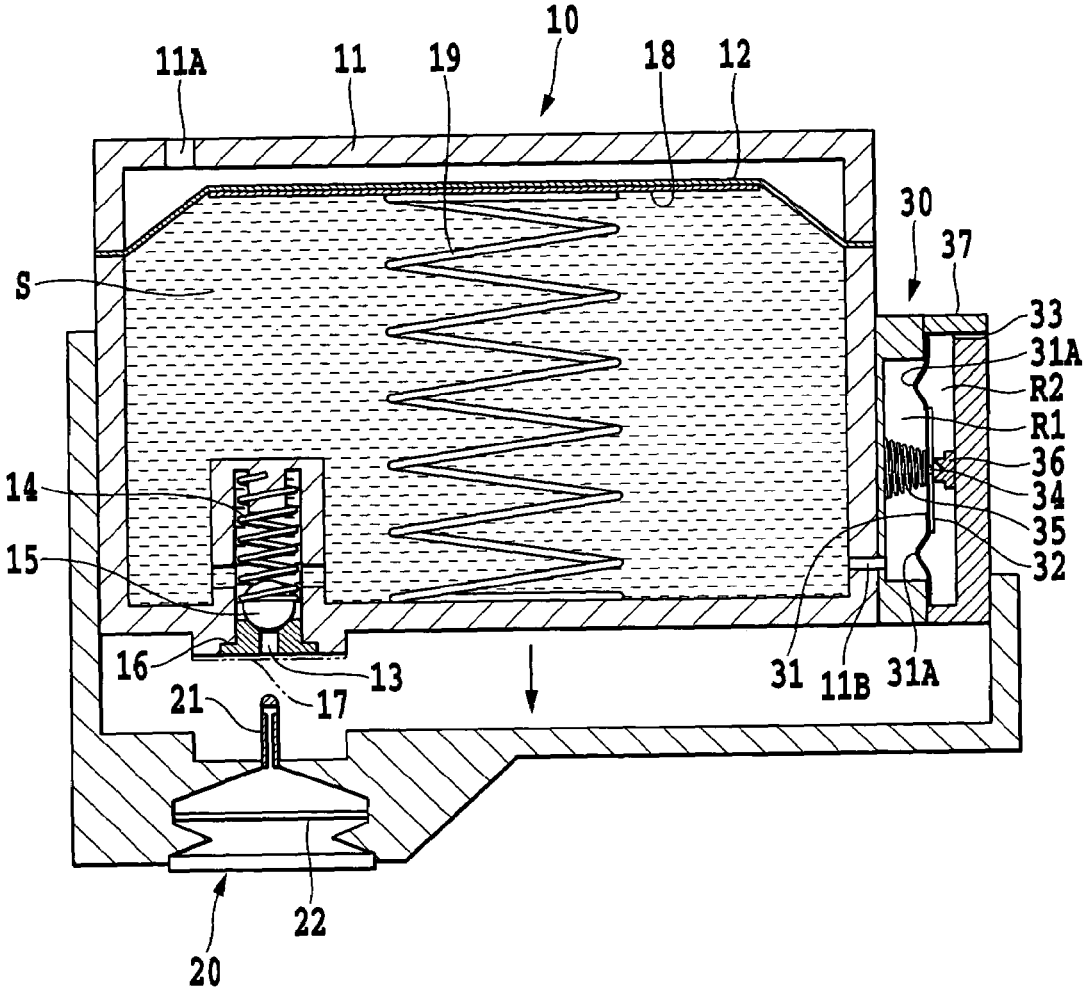
FIG. 1 is a cross-sectional view of a liquid container according to the present invention.

Embodiments of the present invention will be described by referring to the accompanying drawings. The following embodiments concern a liquid container in the form of an ink tank containing ink. It is noted, however, that the present invention can be applied widely to containers used to accommodate a variety of liquids in addition to ink. In a field of an ink jet printing, the present invention can also be applied to a container accommodating a treatment liquid to be applied to a print medium.

(Basic Construction of Liquid Container)

First, a basic construction of an ink tank (liquid container) of the present invention will be explained by referring to a cross section of FIG. 1.

An ink tank 10 of this embodiment has an ink accommodating space S formed between an enclosure 11 and a movable member 12. Ink in the accommodation space S is supplied through a supply port 13 to a print head 20 capable of ejecting ink. The supply port 13 has a ball-shaped plug member 15 urged downward by a connection spring 14. The plug member 15 is pressed against a seal member 16 formed of such an elastic material as rubber to close the supply port 13. Then, mounting the ink tank 10 on the print head 20 causes a supply pipe 21 formed on the print head 20 to enter into the accommodation space S of the ink tank 10, thus communicating the print head 20 with the accommodation space S. As a result, ink can be supplied from the ink tank 10 to the print head 20. Inside the supply pipe 21 is arranged a filter 22 that prevents foreign matters in the ink from flowing into the print head 20. With the ink tank 10 and the print head 20 connected together, the seal member 16 seals a circumference of the supply pipe 21 to make the connection between the supply pipe 21 and the ink tank 10 firm and intimate. Denoted 17 is a separation sheet 17 that seals the supply port 13 and is removed when the ink tank 10 and the print head 20 are coupled.

An ink ejection system of the print head 20 is not limited to a particular type. It may, for instance, use a thermal energy generated by an electrothermal transducer for ejecting ink. In that case, the heat of the electrothermal transducer causes a film boiling in ink to generate a bubble and thereby expel ink from a nozzle.

The ink accommodation space S is formed between the movable member 12 and a lower inner surface of the enclosure 11 as shown in FIG. 1. Another space in the enclosure 11 which is outside the ink accommodation space S, i.e., a space above the movable member 12, is open to the atmosphere through an atmosphere communication port 11A. The accommodation space S forms a virtually hermetically closed space except for the supply port 13 and a communication path 11B described later.

The enclosure 11 defines the ink accommodation space S and also functions as a shell to protect the movable member 12 from external forces. The movable member 12 in this example is formed of a deformable, flexible film (sheet member), with its central portion supported by a flat support plate 18 so that the central portion is restrained in shape and its peripheral portion is deformable. The movable member 12 has its central portion raised with its peripheral portion trailing down like a plateau when seen from the side. This movable member 12 deforms as an ink volume and a pressure in the accommodation space S change, as described later. At this time the peripheral portion of the movable member 12 flexibly deforms with good balance allowing the central portion of the movable member 12 to move up or down while keeping its almost horizontal attitude (translational movement). Since the movable member 12 deforms (or moves) smoothly, no impacts are produced by the deformation, nor do any abnormal pressure variations due to impacts occur in the ink accommodation space.

In the accommodation space S there is a spring member 19, a compression spring, that urges the movable member 12 upward through the support plate 18. A pressing force of the spring member 19 acts on the movable member 12 through the support plate 18 to generate a predetermined level of negative pressure in the accommodation space S. The level of the negative pressure falls in a range that balances with a retaining force of the meniscus formed in the ink ejection portion of the print head 20 and which allows an ink ejection operation of the print head 20. The movable member 12, the support plate 18 and the spring member 19 together form a negative pressure generation mechanism to generate a negative pressure in the accommodation space S. FIG. 1 shows a state in which the accommodation space S is filled with ink almost completely. In this state the spring member 19 is already compressed and there is an appropriate level of negative pressure in the accommodation space S.

The negative pressure generation mechanism for generating the negative pressure in the accommodation space S may be of a type that maintains the volume of the accommodation space S or expands it.

The ink tank 10 has a one-way valve 30 that functions as a negative pressure adjust mechanism.

An interior of the one-way valve 30 is divided into two chambers R1, R2 by a combination of a flexible sheet 31 and a valve closing plate (valve closing member) 32 joined together. One of the chambers (also referred to as a "valve chamber"), R1, is communicated through a communication path 11B to the accommodation space S, while the other chamber R2 is open to the atmosphere through an atmosphere communication port 33. The flexible sheet 31 and the valve closing plate 32 are formed with an opening 34 that communicates the chambers R1, R2 with each other. The flexible sheet 31 and the valve closing plate 32 are urged toward the right in the figure by a valve restraining spring 35 in the valve chamber R1. The flexible sheet 31 and the valve closing plate 32 are pressed against a valve seal member 36 in the chamber R2 to close the opening 34 with the valve seal member 36. Conversely, when the flexible sheet 31 and the valve closing plate 32 are moved toward the left in the figure and part from the valve seal member 36, the opening 34 is released from the valve seal member 36. A peripheral portion of the flexible sheet 31, other than the portion joined with the valve closing plate 32, is deformable and movable so as not to pose any resistance to a minute displacement of the valve closing plate 32. This construction therefore allows a smooth displacement of the valve closing plate 32. The valve chamber R1 maintains a virtually closed space except for the communication path 11B and the opening 34. An enclosure 37 of the one-way valve 30 serves also as a shell that protects the flexible sheet 31 from external forces.

The valve restraining spring 35 works as a valve restraining member to restrain an opening action of the one-way valve 30. The valve restraining spring 35 is slightly compressed and a reactionary force of this compressed spring pushes the valve closing plate 32 toward the right in the figure. As the valve restraining spring 35 is compressed and expanded, the opening 34 comes into or out of hermetic contact with the valve seal member 36, thus functioning as a valve. The opening 34 also works as a one-way valve which, when open, allows a gas to flow therethrough from the chamber R2 into the valve chamber R1.

The valve seal member 36 needs only to be constructed such that it can reliably close the opening 34 airtightly. That is, the valve seal member 36 needs to be shaped so that its portion contacting the opening 34 can reliably seal an opening face (a surface surrounding the opening 34). As for a material used, there are no special requirements, except that the material must be able to secure a hermetically sealed state. However, since this hermetic contact is established by the expansion force of the valve restraining spring 35, it is more preferred that the valve seal member 36 be formed of an elastic, contractible material, such as rubber, that can easily follow the movement of the flexible sheet 31 and valve closing plate 32 driven by the spring 35.

(Basic Operation of Liquid Container)

Next, referring to FIGS. 2A, 2B and 2C, a basic operation of the ink tank (liquid container) of the above-described basic construction will be explained.

Figure 2A:
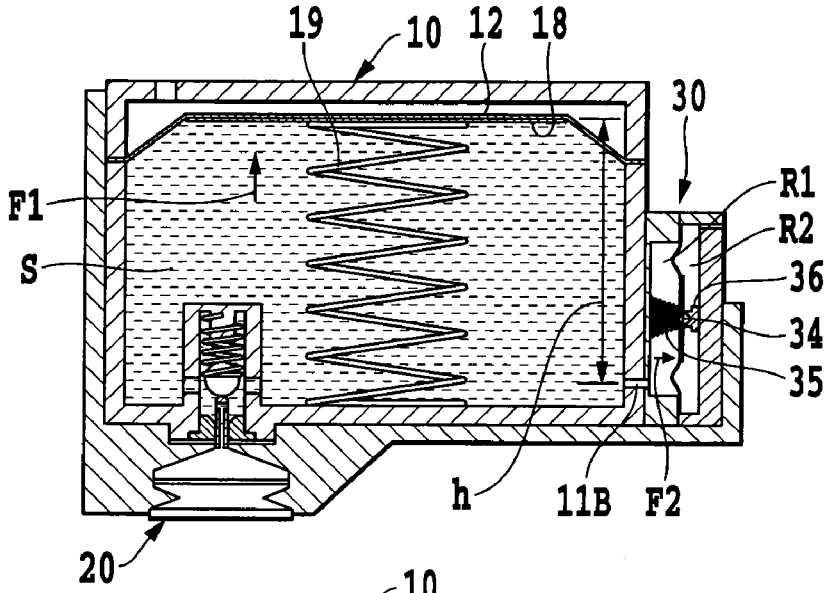
FIGS. 2A, 2B and 2C are cross-sectional views showing an operation of the liquid container of FIG. 1.

FIG. 2A shows a state in which the accommodation space S is filled with ink to its capacity. Since the spring member 19 is in a compressed state, an expansion force F1 (a reactionary force from compression) proportional to the contraction displacement of the spring member 19 acts on the movable member 12 through the support plate 18. The expansion force F1 acts upward in FIG. 2, i.e., in a direction in which the spring member 19 extends. In the following description, this direction is indicated by a positive sign. At this time, the pressure in the accommodation space S acts inwardly of the chamber. That is, if the atmospheric pressure is assumed to be "0", then the pressure P1 in the accommodation space S has a minus sign (negative pressure) according to the rule of sign described above. Therefore, if an area of the support plate 18 engaged with the spring member 19 is assumed to be S, the negative pressure acting on the support plate 18 from within the accommodation space S can be expressed as −F1/S1. In other words, the negative pressure generated in the accommodation space S acts in a direction opposite the force of the spring member 19.

Because of this negative pressure present in the accommodation space S, meniscuses in ink nozzles of the print head 20 are applied a negative pressure P, which in turn prevents an ink leakage from the ink nozzles of the print head 20.

Further, suppose an ink level height in the accommodation space S from the communication path 11B is h ($h \geqq 0$; when the ink level height is lower than the communication path 11B, h=0), a density of liquid (ink) is ρ, and a gravity acceleration is g, then a water head up to the support plate 18 which acts on the meniscus formed in the communication path 11B is given by ρgh and tends to reduce the negative pressure generated in the accommodation space S by the spring member 19 (i.e., acts in a direction that increases the pressure). Thus, the negative pressure P1 at the communication path 11B in the accommodation space S is expressed as $$P1=-F1/S1+\rho gh \tag{1}$$

In this state, the one-way valve 30 has its opening 34 hermetically closed by the valve seal member 36. The valve chamber R1 is subjected to the negative pressure P1 through the communication path 11B connected with the accommodation space S. In this valve chamber R1 the valve restraining spring 35 exerts an expansion force F2 toward the right in the figure, i.e., in a direction in which the valve restraining spring 35 tends to expand. The direction of this expansion force F2 is given a positive sign. An area of that surface of the valve closing plate 32 engaged with the valve restraining spring 35 is taken to be S2. The direction in which the valve restraining spring 35 applies a pressure to the valve closing plate 32 is the same as the direction in which the valve restraining spring 35 tends to expand and is given a positive sign. Thus, if the pressure applied by the valve restraining spring 35 to valve closing plate is assumed to be P2, an area of the support plate 18 engaged with the spring member 19 is assumed to be S1, it can be expressed as $$P2=F2/S2 \tag{2}$$

In this equation a pressure applied by the valve restraining spring 35 to the valve closing plate 32 is taken as positive when it acts toward the right in the figure.

Further, if the pressure produced by a capillary attraction of a meniscus formed in the communication path 11B is denoted by PM (a direction in which PM acts differs depending on whether the meniscus has a convex shape on the left or on the right; in this example the direction in which the convex meniscus protrudes toward the right is taken to be positive), then the pressure P in the valve chamber R1 is given by $$P=-P1-PM$$

In this equation a pressure of air in the valve chamber R1 acting on the valve closing plate 32 is taken as positive when it acts toward the left in the figure. Hence, a condition that needs to be met for the opening 34 to be hermetically closed by the valve seal member 36 is $$P<P2 \quad (3)$$

From equations (2) and (3), we obtain $$P<F2/S2 \quad (4)$$

That is, when the force of the valve restraining spring 35 acting on the valve closing plate 32 and resisting the negative pressure of air in the valve chamber R1 is greater than the negative pressure, the one-way valve 30 remains closed.

As the ink ejection from the print head 20 proceeds and the amount of ink remaining in the ink tank 10 decreases, the negative pressure in the accommodation space S increases.

Figure 2B:
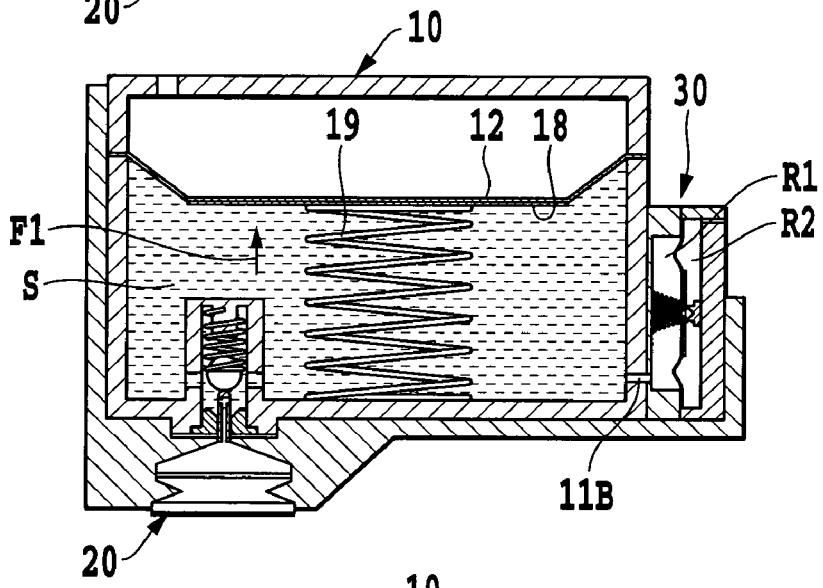

As a result of continuing ink consumption, the state changes from FIG. 2A to FIG. 2B. That is, as the amount of ink remaining in the accommodation space S decreases, the inner volume of the closed accommodation space S also decreases, moving the movable member 12 downward in the figure. The downward displacement of the movable member 12 causes the support plate 18 to also move down, compressing the spring member 19. As the spring member 19 is compressed, the expansion force F1 increases, which in turn increases the negative pressure P1 as seen from equation (1).

In the state of FIG. 2B, the negative pressure of air in the valve chamber R1 balances with the opposing force of the valve restraining spring 35 that bears on the valve closing plate 32. The following relation holds.

$$P=F2/S2 \quad (5)$$

So far, since the valve restraining spring 35 holds the valve closing plate 32 in hermetic contact with the valve seal member 36, the value of F2/F2 remains constant. Then, as the ink consumption continues, the negative pressure in the accommodation space S further increases and reaches a point of $$P>F2/S2 \quad (6)$$

at which time the opening 34 of the valve chamber R1 can no longer be sealed with the valve seal member 36 and thus is opened.

Figure 2C:
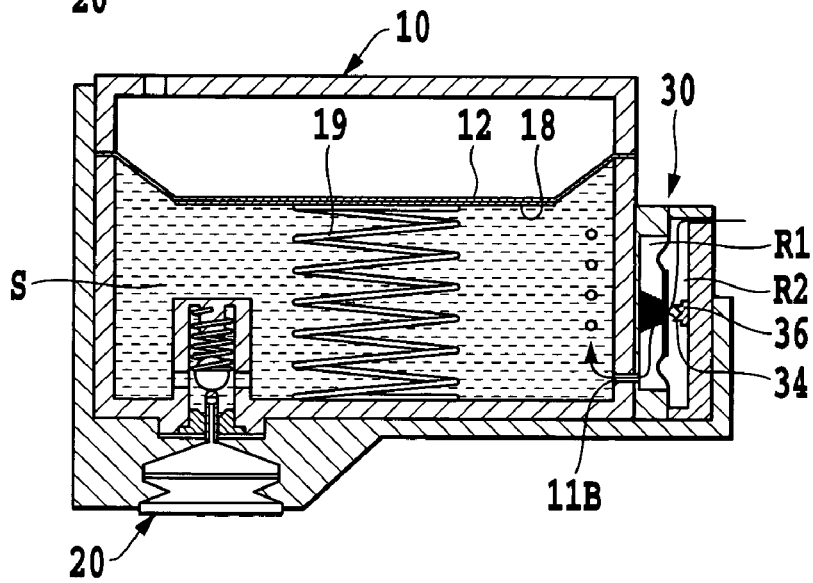

As a result, as shown by an arrow of FIG. 2C, air flows from the chamber R2 into the valve chamber R1 through the opening 34 and further into the accommodation space S through the communication path 11B. The inner volume of the accommodation space S therefore increases, decreasing the negative pressure which has been building up thus far. A reduction in the negative pressure in the accommodation space S causes the container state to return from the state of equation (6) to the state of equation (5), in which the opening 34 of the valve chamber R1 is again hermetically closed with the valve seal member 36, as shown in FIG. 2B.

A condition that needs to be met for the one-way valve 30 to be open is therefore expressed as $$P>F2/S2 \quad (7)$$

After this, as ink consumption proceeds, the one-way valve 30 is repetitively opened and closed to keep the negative pressure in the accommodation space S almost constant during the process of ink consumption. After the ink in the accommodation space S has been consumed to a certain degree, the negative pressure in the accommodation space S is prevented from becoming excessively large, as described above. This makes it possible for the print head 20 to eject ink stably until the ink in the accommodation space S is consumed completely.

(Example Construction of One-Way Valve)

Figure 3:
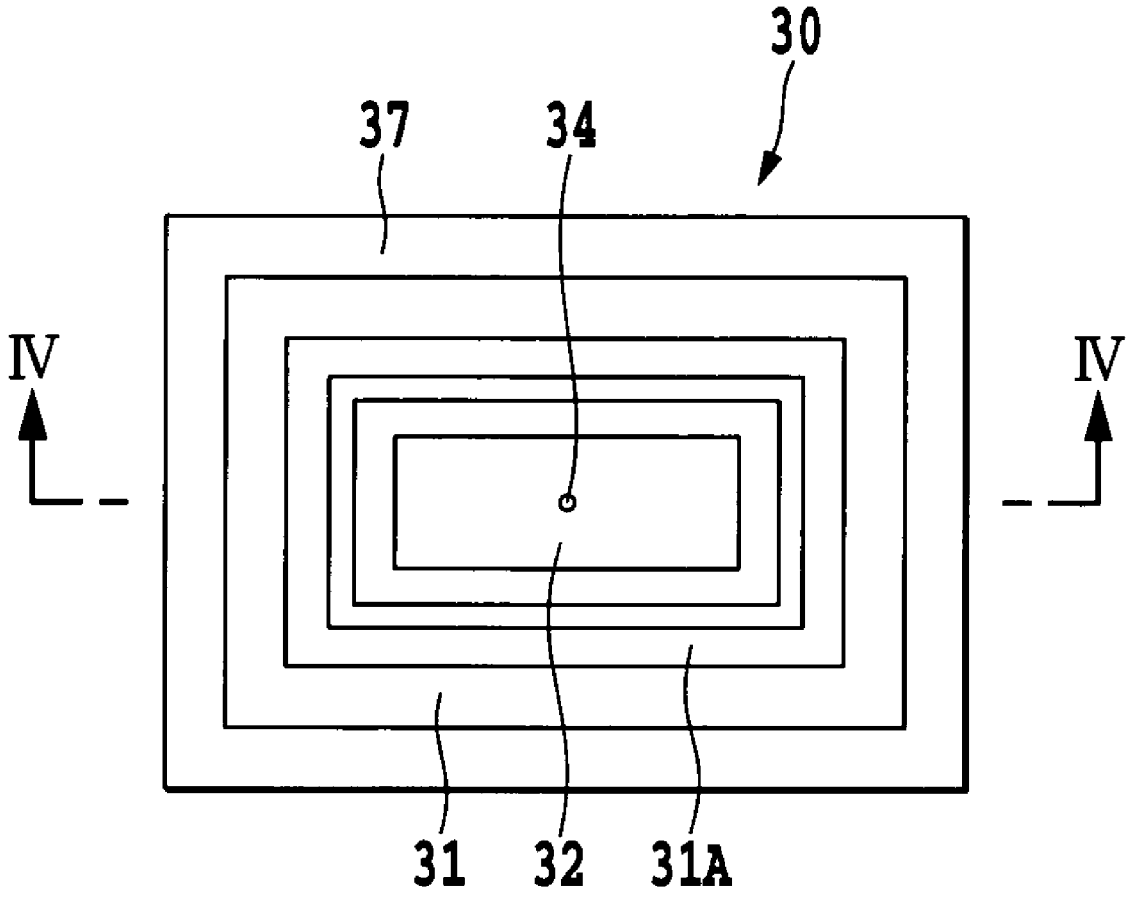
FIG. 3 is a plan view of an essential portion of a one-way valve installed in the liquid container of FIG. 1.
Figure 4A:
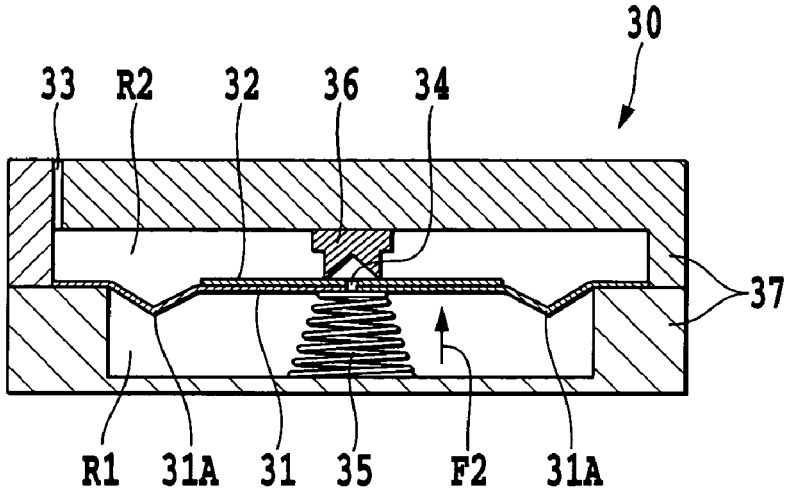
FIGS. 4A and 4B are cross-sectional views taken along the line IV—IV of FIG. 3, showing an operation of the one-way valve installed in the liquid container of FIG. 1.
Figure 4B:
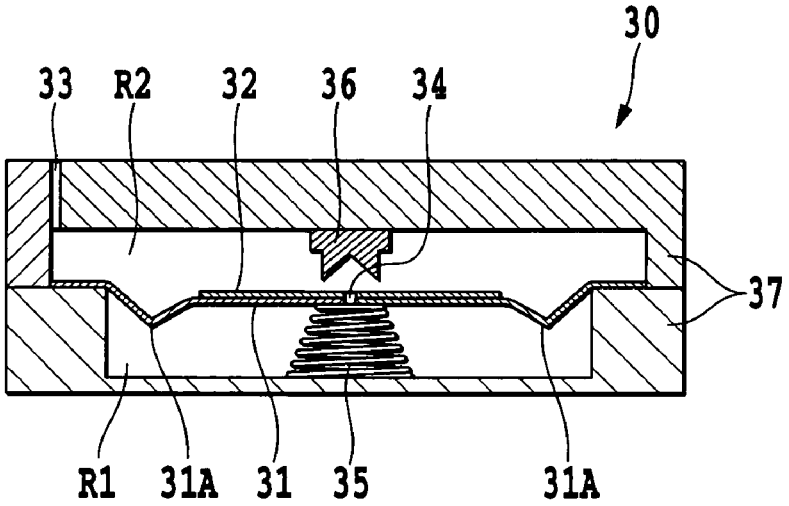

FIG. 3 and FIGS. 4A and 4B illustrate the construction of the one-way valve 30 installed in the ink tank described above. The one-way valve 30 has a function of adjusting a negative pressure in the ink tank 10, which has a negative pressure generation means, to keep the negative pressure in a predetermined range.

The flexible sheet 31 of the one-way valve 30 of this embodiment is formed of a resin member or resin sheet. Materials for this resin sheet include polyolefin films such as polypropylene (PP) and polyethylene (PE), polystyrene films, polyvinylidene chloride (PVDC) and polyvinylchloride (PVC) films, polyvinyl alcohol films and ethylene vinyl alcohol copolymer (EVOH) films, polyamide films, such as nylon and aramid, polyimide films, PET films, polyacrylonitrile (PAN) resin films, fluorinated resin films, and polycarbonate films. These materials may be deposited with aluminum or silica vapor to form composite materials. Further, these films may be laminated together. Especially, by laminating chemical resistant PP and PE films with gas- or vapor-proof PVDC and EVOH films, an excellent ink tank performance can be assured. The sheet member is preferably formed in a thickness range of 10–3000μm considering flexibility and durability.

These resin members and resin sheets used for the flexible sheet 31 are less vulnerable to environmental changes than the elastic members such as rubber and elastomer. Since the flexible sheet 31 is incorporated into the one-way valve 30, which adjusts a pressure by introducing the atmosphere, it is kept out of direct contact with ink (liquid) and thus can enhance reliability of ink and printed images.

If, instead of the flexible sheet 31, a member formed of an elastic material such as thermoplastic elastomer and rubber is used, the member is likely to swell in ink or its characteristics degraded. Thus, if the member is immersed in ink, component materials of the member may dissolved into the ink, degrading reliability of ink and printed images. Further, characteristic changes of the member may render a correct pressure adjustment impossible.

By using the flexible sheet 31 not easily influenced by ambient variations and adopting a construction of the one-way valve 30 that avoids contact between the flexible sheet 31 and ink, reliability of ink and printed images can be enhanced. The resin or resin sheet used as a molding material for the flexible sheet 31, however, has a smaller expansion or contraction capability than such elastic members as elastomer and rubber. So the flexible sheet 31 needs to be formed with a movable area to secure a freedom of deflection of the sheet. For a stable adjustment of a negative pressure and for a size reduction of the one-way valve 30, an onerous challenge is how to form the movable area of the flexible sheet 31 precisely. The present invention stabilizes a negative pressure in the ink tank by restraining deflections of the flexible sheet 31, which is less elastic than other elastic members such as elastomer and rubber, and deforming it stably.

The flexible sheet 31 in the one-way valve 30 has, in its area except the contact portion with the valve closing plate 32, a movable area to allow for smooth deflections of the flexible sheet 31 when the valve closing plate 32 is displaced. The movable area is formed with an undulated portion 31A having recessed and raised portions. The undulated portion 31A of this example is situated along the circumference of the valve closing plate 32, which is rectangular when seen from above as shown in FIG. 3. The undulated portion 31A protrudes from the chamber R2 on a high pressure (atmospheric pressure) side toward the valve chamber R1 on a low pressure (negative pressure) side, as shown in FIG. 4A. Therefore, the undulated portion 31A has a recessed shaped in the chamber R2 on the high pressure side and a raised shaped in the valve chamber R1 on the low pressure side. This undulated portion 31A is formed in advance in the flexible sheet 31 which is then assembled into the one-way valve 30. In this process, the flexible sheet 31 is assembled in an attitude shown in FIG. 4A to keep the shape of the undulated portion 31A intact.

The undulated portion 31A formed as described above can reduce a stiffness of the flexible sheet 31 and, as described later, has an effect of restraining a direction of deformation of the flexible sheet 31 by the shape of undulation. As a result, the valve closing plate 32 can be moved smoothly and stably, contributing to a further stabilization of the negative pressure.

The pressure P in the valve chamber R1 is always smaller than the atmospheric pressure in the chamber R2. Thus, the flexible sheet 31 is acted upon by a differential pressure from the chamber R2 side toward the valve chamber R1 side at all times. This differential pressure deforms the flexible sheet 31 from the chamber R2 side toward the valve chamber R1 side. The deforming form of the sheet is agree with the original undulation form of the undulated portion 31A formed in advance. Thus, whether the one-way valve 30 is closed as shown in FIG. 4A or open as shown in FIG. 4B, the undulated shape of the undulated portion 31A remains basically unchanged, protruding from the chamber R2 side toward the valve chamber R1 side, with only the degrees of projection and curvature changing.

The fact that the undulated shape of the undulated portion 31A is maintained in the operation range of the one-way valve 30 means that the direction of deformation of the flexible sheet 31 is limited to a direction that maintains the undulated shape of the undulated portion 31A. As a result of this restriction of the deformation direction of the flexible sheet 31, the valve closing plate 32 can be moved more smoothly and stably, keeping the negative pressure more stable, than when the flexible sheet 31 is deformed irregularly.

The flexible sheet 31 of such a construction deforms according to a magnitude of the negative pressure P in the valve chamber R1 while maintaining the basic undulated configuration of the undulated portion 31A, with the amount of deformation changing continuously. Thus, the stress of the flexible sheet 31 produced by the pressure P changes continuously with accordance to the pressure P. For example, if a stress change of the flexible sheet 31 is plotted with an ordinate representing the pressure P and an abscissa representing the stress of the flexible sheet 31, the stress characteristic will be a curve or straight line with no knee point (or point of change). Consider a process in which the one-way valve 30 shifts from the closed state (see FIG. 4A) to the open state (see FIG. 4B). As the negative pressure P in the valve chamber R1 increases, the deformation of the flexible sheet 31 increases continuously reducing the volume of the valve chamber R1 progressively. That is, the negative pressure P increases stably until the condition of equation (7) is satisfied, at which time the valve is opened. In this way, the one-way valve 30 is reliably operated stabilizing the negative pressure in the accommodation space S.

Since the basic undulated shape of the undulated portion 31A of the flexible sheet 31 is maintained as described above, the one-way valve 30 required to perform a sensitive operation in response to minute negative pressure changes in the valve chamber R1 can fully implement its intended function. The undulated shape of the undulated portion 31A need only be maintained in at least an operation range of the one-way valve 30. Here, the maintenance of the undulated shape of the undulated portion 31A means that the basic form or configuration is maintained while only the degrees of projection and curvature change. In terms of mechanical force, the maintenance of the undulated shape means that the stress of the flexible sheet 31 caused by the negative pressure in the valve chamber R1 changes along a smooth curve or straight line with no knee point (point of change) or point of discontinuity.

If the stress curve of the flexible sheet 31 has a knee point or point of discontinuity at which the stress changes greatly, the deformation of the flexible sheet 31 shows a sharp change at or around the knee point or discontinuous point. Such a sharp change in the amount of deformation results in a sharp change in the volume of the valve chamber R1 and therefore a sharp change in the pressure P in the valve chamber R1. This in turn shifts a timing at which the one-way valve 30 is operated, rendering the negative pressure in the accommodation space S unstable.

Comparative examples in which the flexible sheet 31 shows a sharp change in the amount of deformation are shown in FIGS. 5A and 5B and FIGS. 6A and 6B for comparison with the embodiment of the present invention.

COMPARATIVE EXAMPLE FOR COMPARISON WITH EMBODIMENT

Figure 5A:
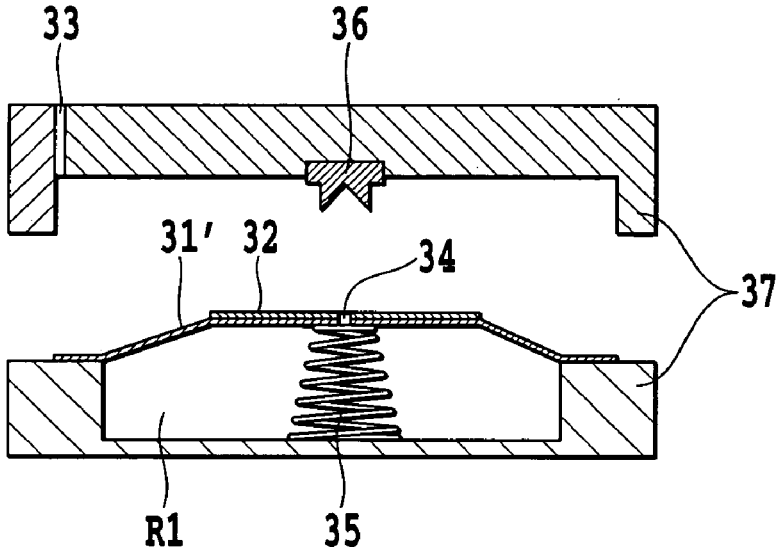
FIGS. 5A and 5B are cross-sectional views showing a method of manufacturing a one-way valve as a comparative example for comparison with the embodiment of the present invention.
Figure 5B:
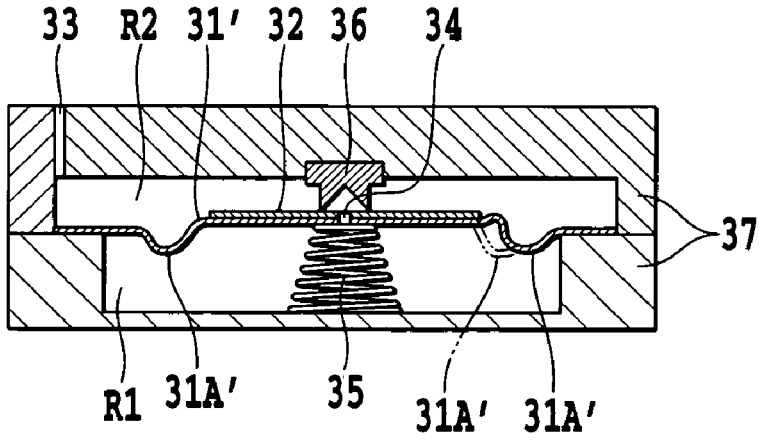

In the example, a planar flexible sheet 31' is used as the flexible sheet of the one-way valve 30. In a process of assembling the one-way valve, the flexible sheet 31' is raised at its central portion by the valve restraining spring 35 as shown in FIG. 5A and then is pushed down by the valve seal member 36 to form an irregular fold or wrinkle in a undulated portion 31A' as shown in FIG. 5B. That is, after the flexible sheet 31' is given a tension by the valve restraining spring 35, a portion around the opening 34 is pressed down by the valve seal member 36 to close the opening 34. As the opening 34 is closed, an irregular fold is formed in the freely deformable undulated portion 31A'. This undulated portion 31A' assures a freedom of deflection of the flexible sheet 31'.

However, the undulated portion 31A' in which an irregular fold is formed may cause a sudden sharp change in the amount of deformation as the pressure P in the valve chamber R1 changes. Suppose, for example, a fold is formed in the undulated portion 31A' on the right side and protrudes toward the chamber R2 as shown in FIG. 5B. When the negative pressure P in the valve chamber R1 increases, the convex portion of the fold may invert to the valve chamber R1 side instantaneously, as indicated by two-dotted chain lines. When the shape of the fold is reversed as described above, a discontinuous point occurs in the stress curve of the flexible sheet and, at and around the discontinuous point, the amount of deformation of the flexible sheet 31' changes greatly and suddenly. This sudden and sharp deformation of the flexible sheet 31' renders the negative pressure unstable, as described above. In the case of FIG. 5B, an imbalance in deformation between the left and right undulated portion 31A' causes the valve closing plate 32 to tilt, which in turn may result in erroneous operations.

Figure 6A:
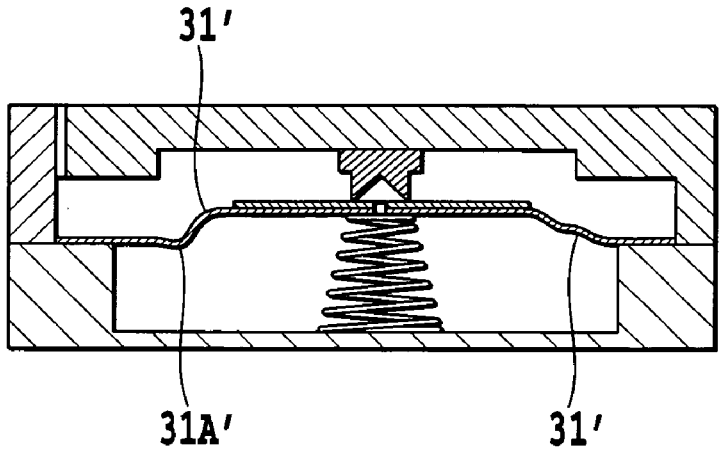
FIGS. 6A and 6B are cross-sectional views showing an operation of an one-way valve as a comparative example for comparison with the embodiment of the present invention.
Figure 6B:
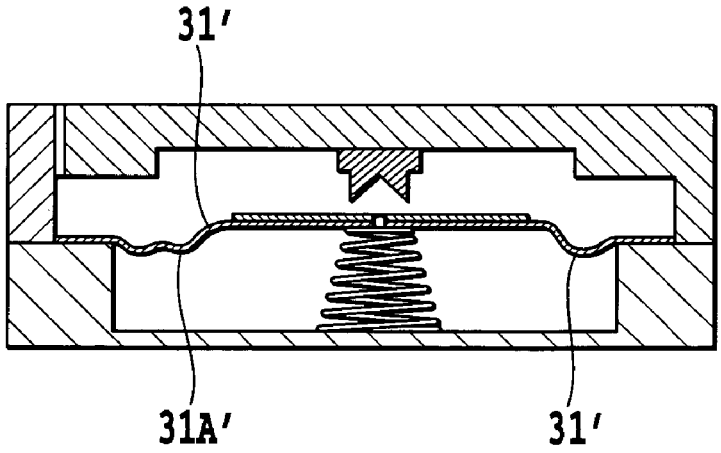

The fold formed in the undulated portion 31A' changes in various ways depending on stiffness and moldability of the flexible sheet and variations in parts precision and assembly accuracy of the valve seal member 36 and valve closing plate 32. For example, irregular folds formed in the undulated portion 31A' shown in FIG. 6A may change its undulated state irregularly according to a pressure change in the valve chamber R1, as shown in FIG. 6B. When the undulated state of the fold changes in this manner, a knee point appears in the stress curve of the flexible sheet and, at and around this discontinuous pint, the amount of deformation of the flexible sheet 31' sharply changes. Such a sharp change in deformation of the flexible sheet 31' results in variations of operation of the one-way valve, thus making the negative pressure unstable.

With the present invention, the valve closing plate 32 can be moved stably to stabilize the negative pressure by forming in a movable area of the flexible sheet 31 the undulated portion 31A that maintains its predetermined undulated form.

Figure 22A:
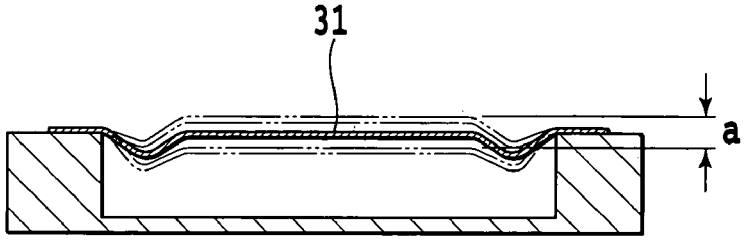
FIG. 22A illustrates a movable area in which a seat of the one-way valve installed in the liquid container of the present invention.
Figure 22B:
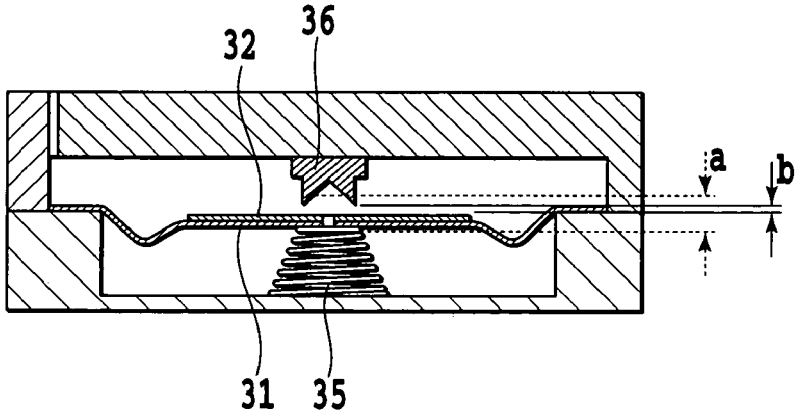
FIG. 22B shows a relation between the movable area of the seat of FIG. 22A and an operation range of a valve mechanism.

FIGS. 22A and 22B are explanatory diagrams showing a movable area of the flexible sheet 31 and a valve operation range.

In FIG. 22A, reference symbol a denotes an operation range of the flexible sheet 31 that forms a one-way valve. In this operation range a, a preformed, undulated shape of the sheet 31 develops no deformation. In FIG. 22B, reference symbol b represents an operation range of an open-close operation of the one-way valve. In the present invention, the operation range b of the one-way valve lies in the operation range a of the sheet 31 in which the shape of the sheet 31 is maintained. So, the shape of the undulated portion of the sheet 31 is maintained before and after the open-close operation of the one-way valve. Thus, a smooth open-close operation can be performed without causing pressure variations as would occur in the case of FIGS. 5A and 5B and FIGS. 6A and 6B.

(Other Locations where Undulated Portion is Formed)

Figure 7A:
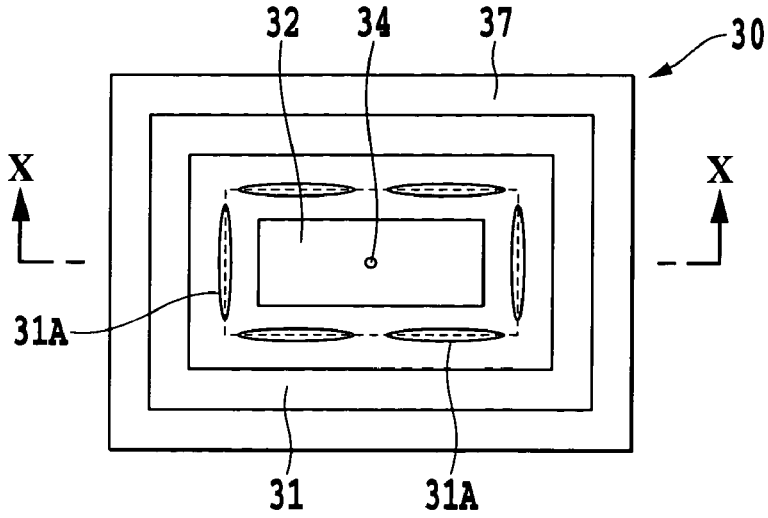
FIGS. 7A, 7B and 7C are plan views of essential portions of variations of one-way valve with protrusions formed at different positions from those of FIG. 3.
Figure 7B:
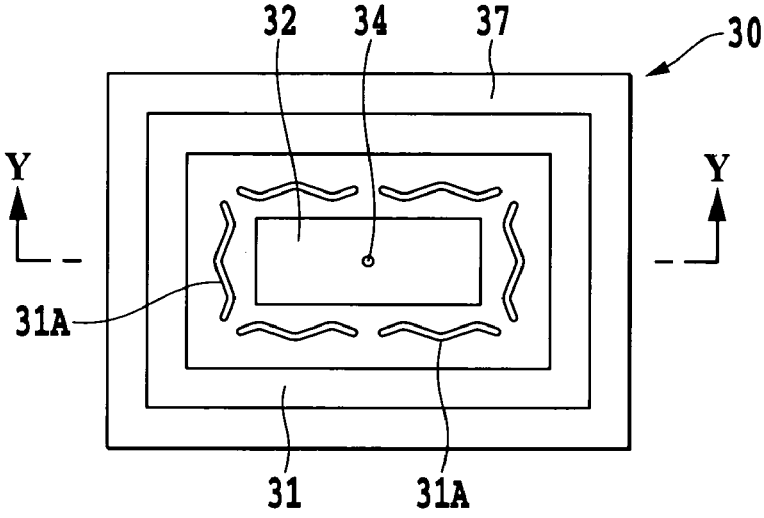
Figure 7C:
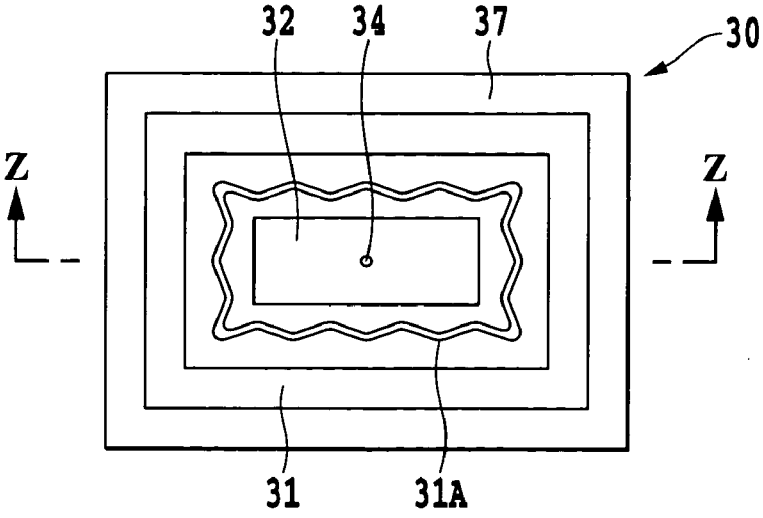

FIGS. 7A, 7B and 7C are plan views showing other example positions in the flexible sheet 31 where the undulated portion 31A is formed.

In FIG. 7A and FIG. 7B, the undulated portion 31A is formed at a plurality of positions along the movable area of the flexible sheet 31, with the undulated portions in FIG. 7A shaped like ellipses and that of FIG. 7B shaped like waves when seen from above. In the case of FIG. 7C, the undulated portion 31A which looks like a wave when seen from above is formed continuous along the movable area of the flexible sheet 31. The undulated portion 31A can take any desired shape as long as it does not cause a sudden change in deformation of the flexible sheet 31, as described above. It is preferred that an undulated portion be formed at such a position as will form a shape similar to an outer periphery of the valve closing plate 32 and that it extend continuously along the periphery of the valve closing plate 32. This arrangement allows the flexible sheet 31 to be deformed more smoothly. Cross sections along X—X, Y—Y and Z—Z lines in FIGS. 7A, 7B and 7C are similar to those of FIG. 4A and FIG. 4B.

It is also possible to form a plurality of undulated portions 31A, circular in plan view, at scattered positions along the movable area of the flexible sheet 31. In that case, undulated circular portions 31A may be arranged at intervals in line along the valve closing plate 32 or randomly scattered along the valve closing plate 32.

(Other Constructions of One-Way Valve)

FIGS. 8A to 12B illustrate other constructions of the one-way valve 30. In these example constructions cross-sectional shapes of the undulated portion 31A of the flexible sheet 31 differ from that of the previous embodiment.

Figure 8A:
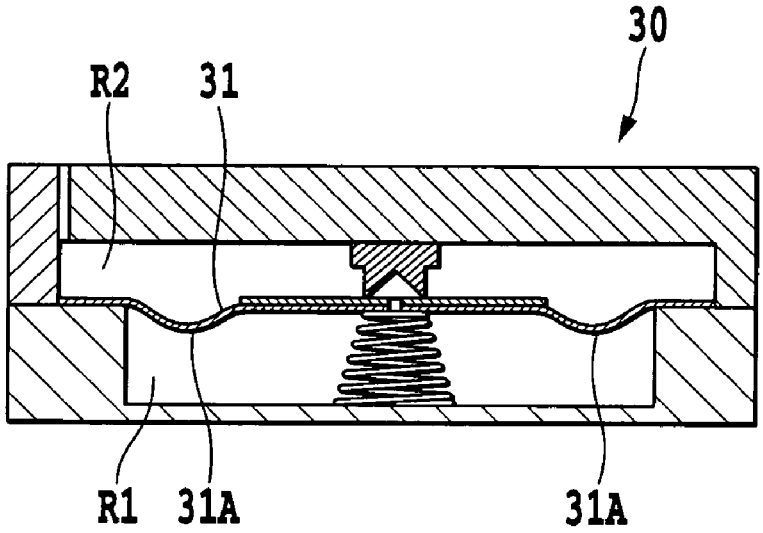
FIGS. 8A and 8B are cross-sectional views showing an operation of another example of one-way valve with protrusions formed in a different shape from that of FIGS. 4A and 4B.
Figure 8B:
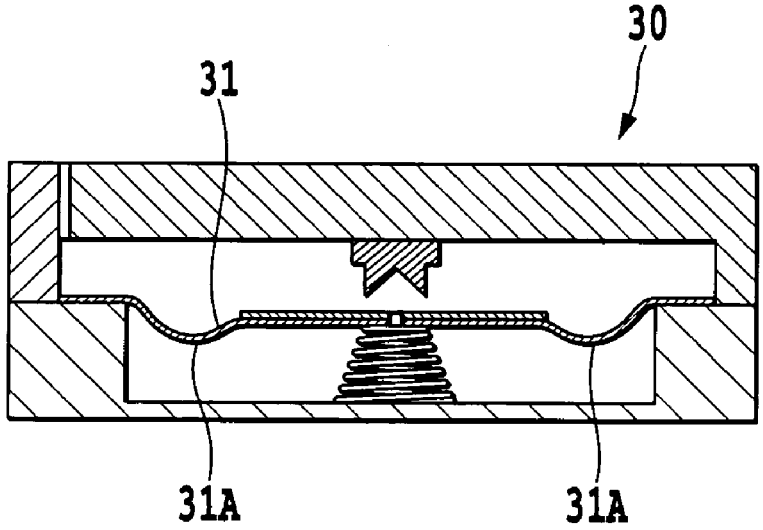

In FIGS. 8A and 8B, the undulated portion 31A of the flexible sheet 31 is not acute-angled as in the embodiment of FIG. 4A and FIG. 4B but is moderately curved. If the stiffness of the flexible sheet 31 is undesirably increased by the acute-angled shape such as shown in FIG. 4A and FIG. 4B, the curved shape of this example is preferably used in maintaining flexibility of the sheet. In this example, too, the undulated portion 31A keeps the intended form of the flexible sheet 31 unchanged, protruding from the chamber R2 side toward the valve chamber R1 side, with only the degrees of projection and curvature differing, whether the one-way valve is closed as in FIG. 8A or open as in FIG. 8B.

Figure 9A:
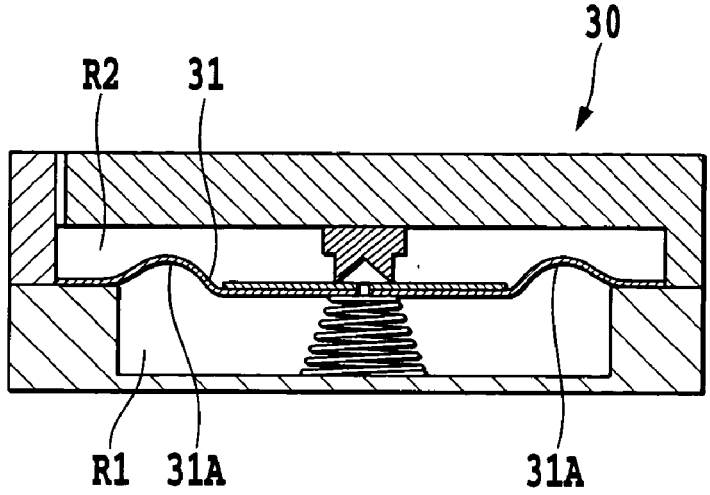
FIGS. 9A and 9B are cross-sectional views showing an operation of still another example of one-way valve with protrusions formed in a different shape from that of FIGS. 4A and 4B.
Figure 9B:
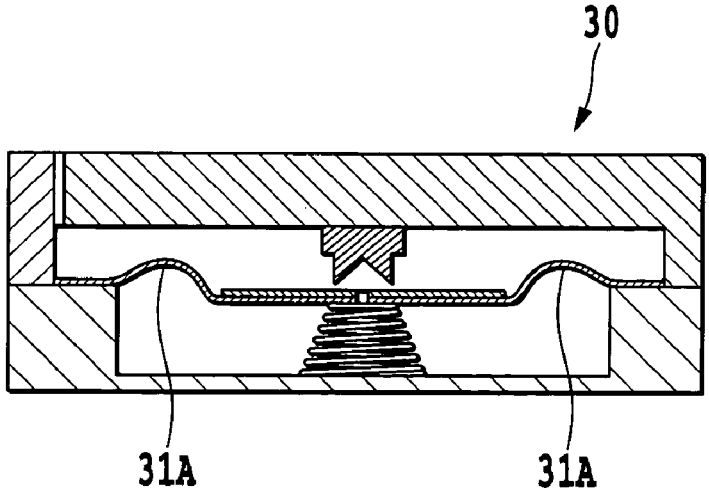
Figure 10A:
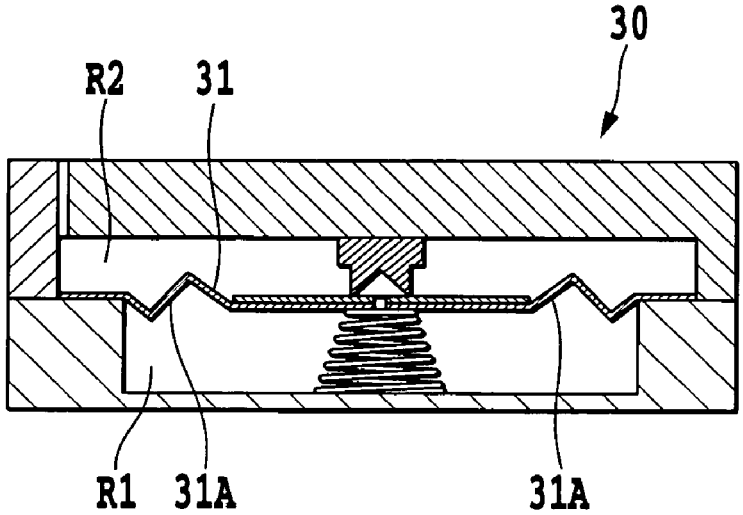
FIGS. 10A and 10B are cross-sectional views showing an operation of a further example of one-way valve with protrusions formed in a different shape from that of FIGS. 4A and 4B.
Figure 10B:
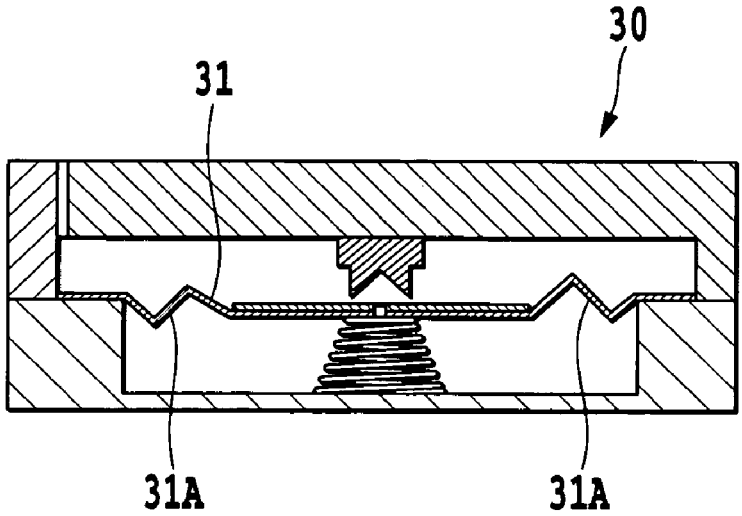
Figure 11A:
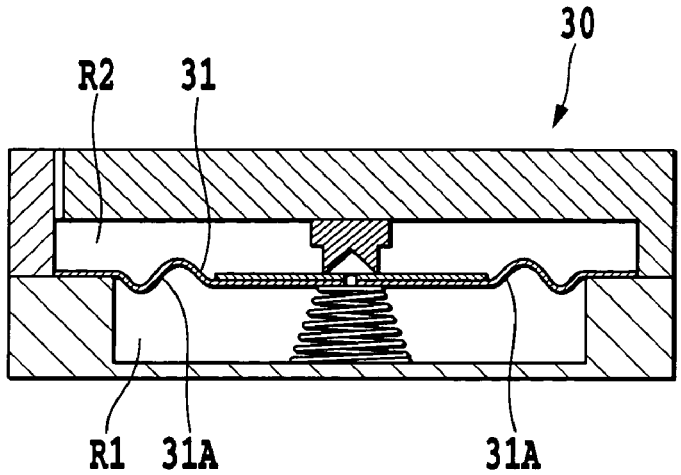
FIGS. 11A and 11B are cross-sectional views showing an operation of a further example of one-way valve with protrusions formed in a different shape from that of FIGS. 4A and 4B.
Figure 11B:
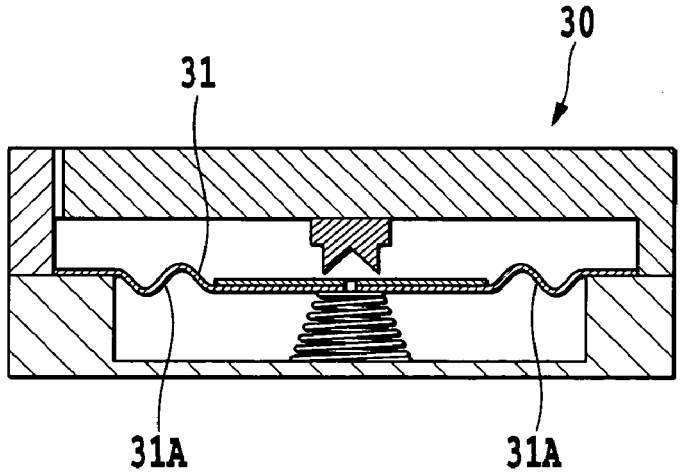
Figure 12A:
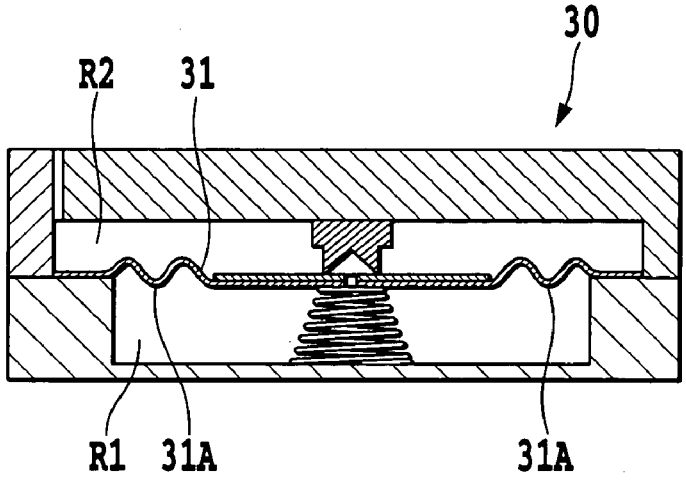
FIGS. 12A and 12B are cross-sectional views showing an operation of a further example of one-way valve with protrusions formed in a different shape from that of FIGS. 4A and 4B.
Figure 12B:
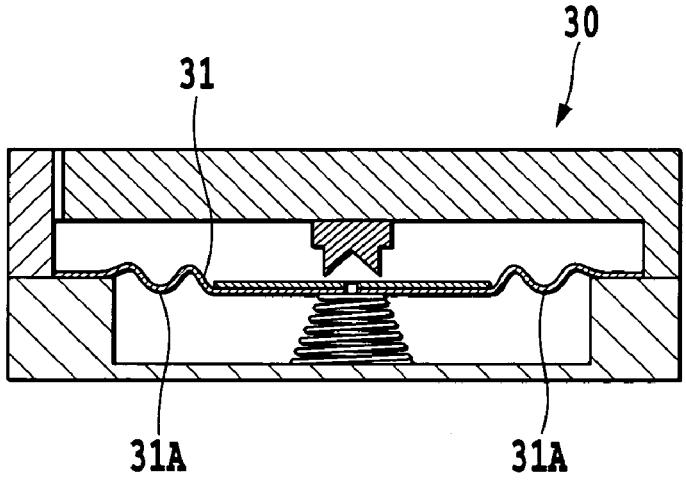

In FIG. 9A and FIG. 9B, the undulated portion 31A of the flexible sheet 31 is smoothly curved to protrude from the low-pressure valve chamber R1 side toward the high-pressure chamber R2 side in a direction opposite that of FIG. 8A and FIG. 8B. In this example, too, the undulated portion 31A maintains the intended, undulated shape of the flexible sheet 31 protruding from the valve chamber R1 side toward the chamber R2 side, whether the one-way valve is closed as in FIG. 9A or open as in FIG. 9B. It can be seen from above that as long as the undulated form of the undulated portion 31A is kept unchanged in the operation range of the one-way valve 30, the same effect as that of the above embodiment can be produced, whatever undulated shape of the undulated portion 31A may take. However, to ensure that the valve closing plate 32 is smoothly displaced by using a flexible sheet with a low stiffness, it is preferable to have the undulated portion protrude in a direction in which the flexible sheet deflects when subjected to a pressure, as in FIGS. 4A and 4B and FIGS. 8A and 8B.

In FIGS. 10A and 10B, FIGS. 11A and 11B and FIGS. 12A and 12B, the undulated portion 31A of the flexible sheet 31 has a plurality of undulations or folds. Two undulations are formed in the undulated portion 31A of FIGS. 10A and 10B and FIGS. 11A and 11B, and three undulations in FIGS. 12A and 12B. In these examples, too, the undulated portion 31A maintains the intended, undulated shape of the flexible sheet 31, whether the one-way valve is closed as in FIGS. 10A, 11A and 12A or open as in FIGS. 10B, 11B and 12B. The undulated portion 31A may also be formed with four or more undulations.

It is noted that, as long as the undulated portion 31A is kept in an intended undulated shape in the operation range of the one-way valve 30, the undulated portion 31A can take any desired shape. If the preformed, undulated shape of the undulated portion of the flexible sheet differs from an undulated shape it takes when the flexible sheet is assembled into the one-way valve, the only requirement that needs to be met is that the undulated shape of the undulated portion of the flexible sheet assembled into the one-way valve be kept unchanged in the operation range of the one-way valve.

(Other Constructions of Valve Closing Plate)

FIGS. 13A and 13B and FIGS. 14A and 14B show other example constructions of the valve closing plate 32. In these constructions, the valve closing plate 32 differs in plan-view shape from the previous embodiment.

Figure 13A:
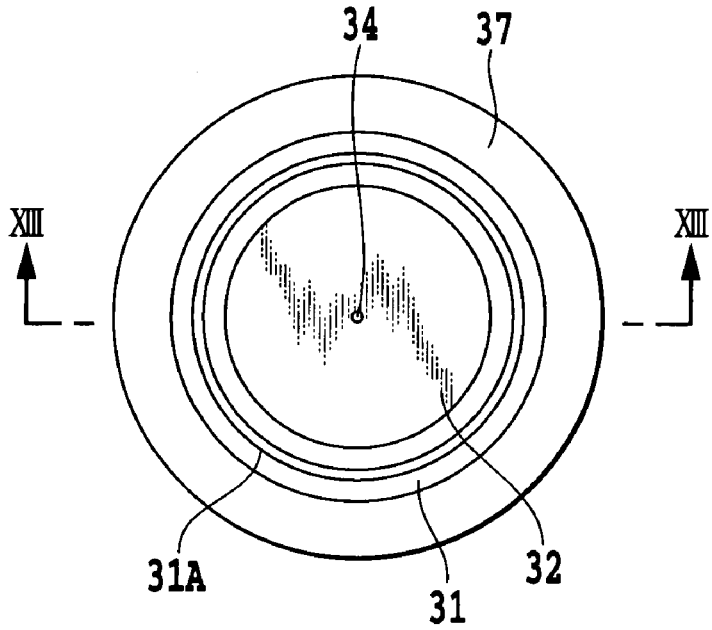
FIG. 13A is a plan view of an essential portion of another variation of one-way valve with a protrusion formed at a different position from that of FIG. 3.
Figure 13B:
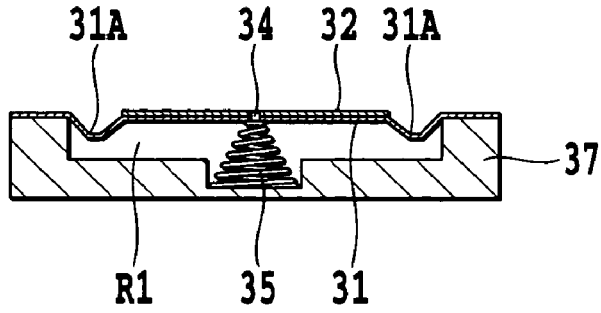
FIG. 13B is a cross-sectional view taken along the line XIII—XIII of FIG. 13A.

FIGS. 13A and 13B are a plan view and a cross-sectional view of a one-way valve constructed of a valve closing plate 32 almost circular when viewed from above. The valve closing plate of the previous embodiment has a roughly rectangular shape in plan view as shown in FIG. 3. With such a rectangular valve closing plate, a side surface of a roughly rectangular prism-shaped ink tank (liquid container) and a side surface of the one-way valve can be set flush with each other. This arrangement has an advantage of being able to enhance an efficiency of accommodating ink in the ink tank. However, since the valve closing plate is rectangular, undulations in the undulated portion of the flexible sheet cross each other at portions corresponding to the vertices of the valve closing plate, slightly increasing the stiffness of the flexible sheet at these corners. To deal with this problem, the valve closing plate 32 is formed almost circular in plan view, as shown in FIG. 13A, to eliminate the intersecting portions and thereby allow the flexible sheet 31 to be deformed more smoothly.

Figure 14A:
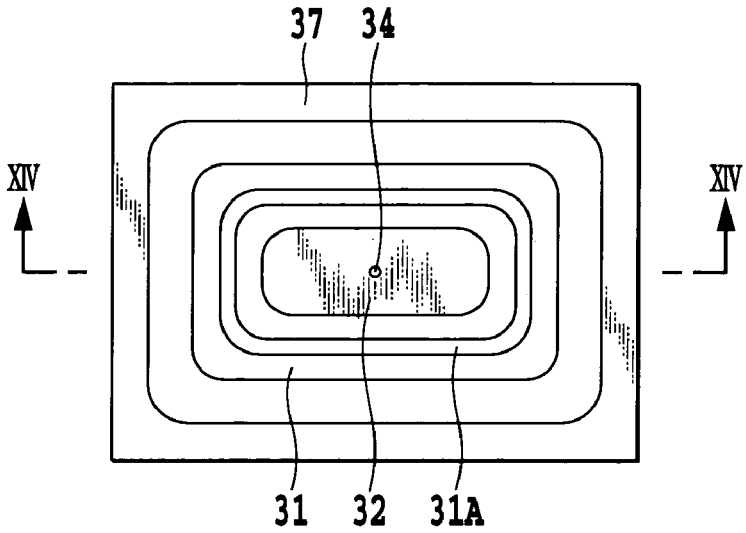
FIG. 14A is a plan view of an essential portion of still another variation of one-way valve with a protrusion formed at a different position from that of FIG. 3.
Figure 14B:
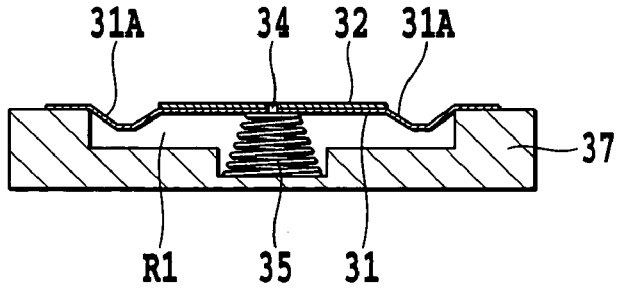
FIG. 14B is a cross-sectional view taken along the line XIV—XIV of FIG. 14A.

In FIGS. 14A and 14B, the valve closing plate 32 is formed almost rectangular in plan view, with its four corners rounded or curved. It is seen that, if the plan-view shape of the valve closing plate 32 is rectangular, this arrangement makes it possible to prevent the undulations of the undulated portion of the flexible sheet from crossing each other at portions corresponding to the vertices of the valve closing plate and therefore the stiffness of the flexible sheet from increasing locally.

(Example of Manufacturing Method)

FIGS. 15A to 15D show one example method of manufacturing a one-way valve 30. FIG. 16A to FIG. 18D show methods of molding the flexible sheet 31 used in the one-way valve manufacturing method.

Figure 15A:
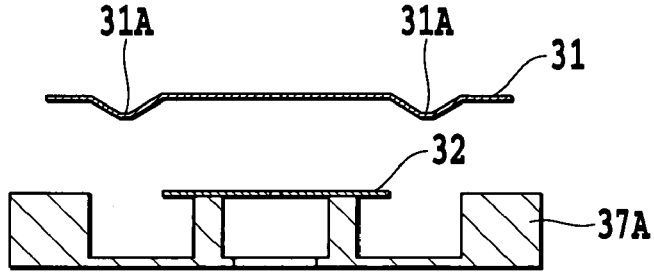
FIGS. 15A, 15B, 15C and 15D are cross-sectional views showing a method of manufacturing a one-way valve installed in the liquid container of the present invention.

First, a flexible sheet 31 is prepared in which an undulated portion 31A of a predetermined shape is preformed. Then, the flexible sheet 31 and the valve closing plate 32 are positioned on a part 37A of the enclosure of the one-way valve, as shown in FIG. 15A. The flexible sheet 31 is not limited to the structure of this example but may be formed into a variety of shapes such as shown in the previous embodiment.

Figure 15B:
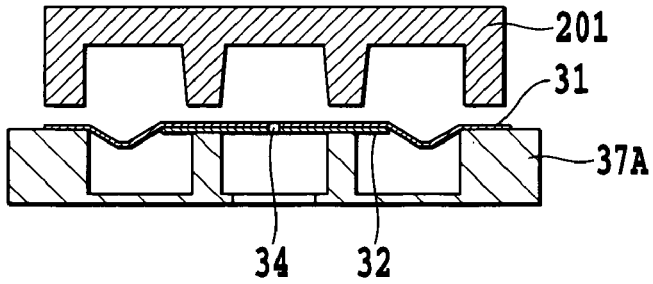
Figure 15C:
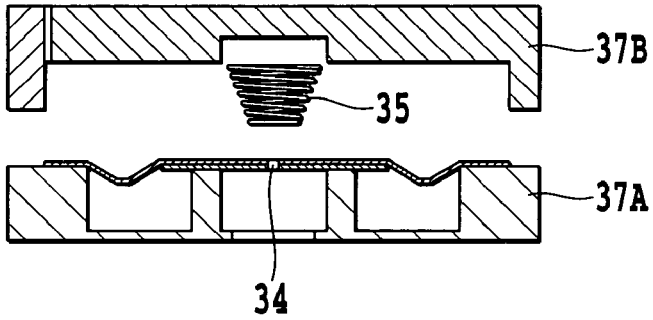
Figure 15D:
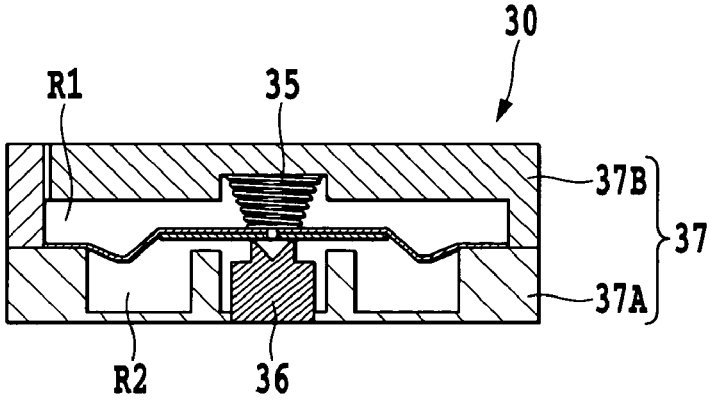

Next, as shown in FIG. 15B, joint surfaces between the part 37A of enclosure and the flexible sheet 31 and joint surfaces between the flexible sheet 31 and the valve closing plate 32 are joined by using a fusing horn 201. Then, as shown in FIG. 15C, another part 37B of the enclosure having a valve restraining spring 35 as a biasing member and the enclosure part 37A fitted with the flexible sheet 31 are positioned and joined together. Then, as shown in FIG. 15D, a seal member 36 is secured to the enclosure part 37A. Now the one-way valve 30 is completed. The one-way valve 30 is assembled into the ink tank 10 as shown in FIG. 1.

The flexible sheet 31 used here can be molded, for example, by the methods shown in FIGS. 16A to 18D.

Figure 16A:
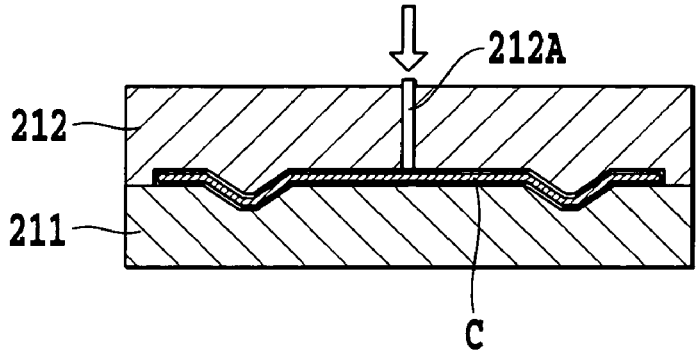
FIGS. 16A and 16B are cross-sectional views showing a method of molding a flexible sheet used in the manufacturing method of FIGS. 15A, 15B, 15C, 15D.
Figure 16B:
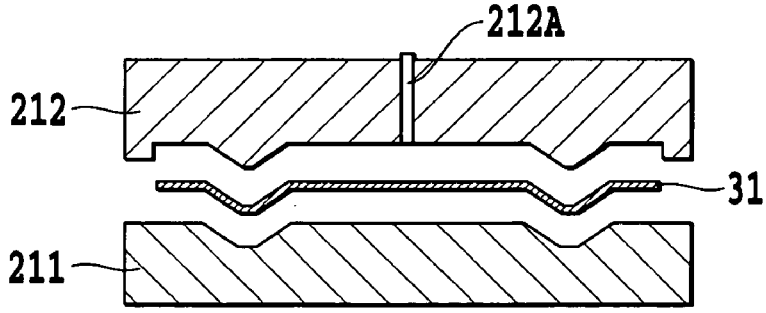

A molding method shown in FIGS. 16A and 16B pours a resin from an inlet 212A into a cavity C formed between injection molding dies 211, 212 as shown in FIG. 16A and injection-molds it into the flexible sheet 31 as shown in FIG. 16B.

Figure 17A:
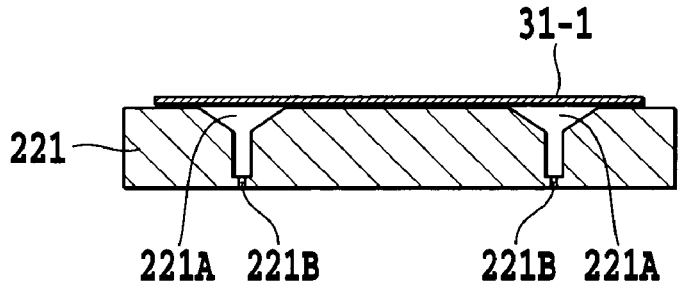
FIGS. 17A and 17B are cross-sectional views showing another method of molding a flexible sheet used in the manufacturing method of FIGS. 15A, 15B, 15C, 15D.
Figure 17B:
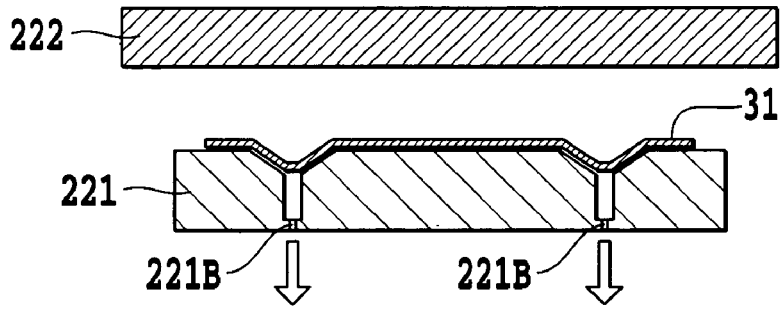

A molding method shown in FIGS. 17A and 17B involves setting a flat, flexible sheet material 31-1 on a die 221, hermetically closing molding portions 221A, which are used to mold the flexible sheet material 31-1 into the undulated portion 31A, as shown in FIG. 17A, then heating the sheet material 31-1 with a heater 222 and at the same time sucking air out of the hermetically closed space in the molding portion 221A through suction ports 221B. With this vacuum molding, the undulated portion 31A is molded to form the flexible sheet 31.

Figure 18A:
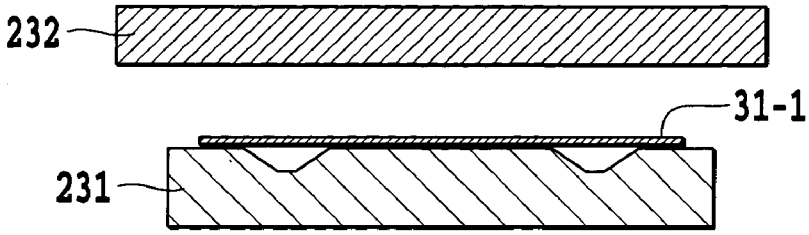
FIGS. 18A, 18B, 18C and 18D are cross-sectional views showing still another method of molding a flexible sheet used in the manufacturing method of FIGS. 15A, 15B, 15C, 15D.
Figure 18B:
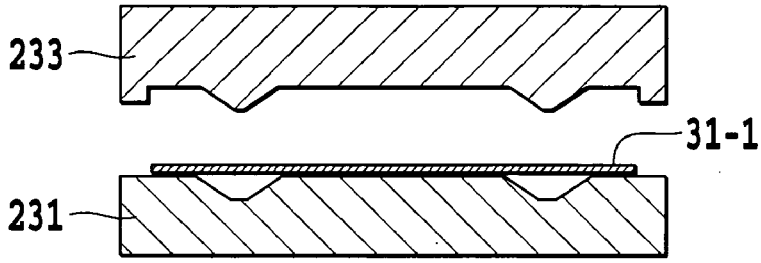
Figure 18C:
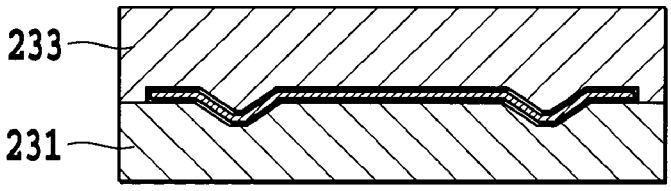
Figure 18D:
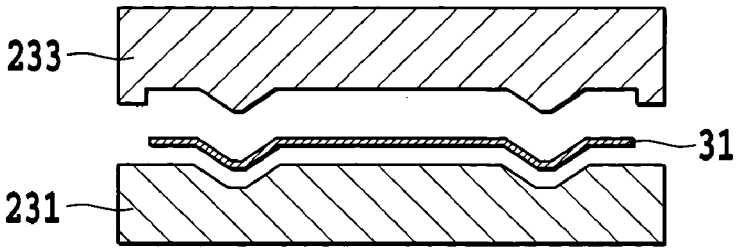

A molding method shown in FIGS. 18A to 18D first heats the flat, flexible sheet material 31-1, by a heater 232, set on a molding die (female die) 231, as shown in FIG. 18A. Then, as shown in FIG. 18B and FIG. 18C, the die 231 and the mating die (male) 233 are pressed against each other to mold the softened sheet material 31-1 into the flexible sheet 31 of FIG. 18D.

With these molding methods, various shapes of flexible sheet 31 can be formed.

(Another Manufacturing Methods)

FIGS. 19A to 19E show another method of manufacturing the one-way valve 30. In this method, a flat, flexible sheet material is joined to the one-way valve (or ink tank) and then a shape of a shaping portion of the one-way valve (or ink tank) is used to mold the flexible sheet.

Figure 19A:
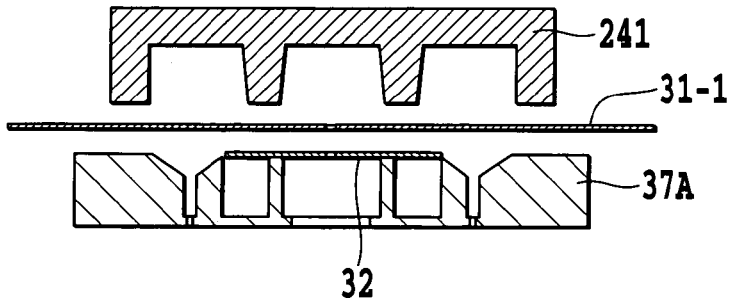
FIGS. 19A, 19B, 19C, 19D and 19E are cross-sectional views showing another method of manufacturing a one-way valve installed in the liquid container of the present invention.
Figure 19B:
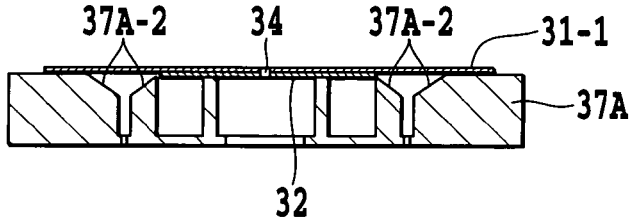

First, as shown in FIG. 19A, the valve closing plate 32 is positioned on the enclosure part 37A of the one-way valve and then the flat, flexible sheet material 31-1 is set. A fusing horn 241 is used to join the enclosure part 37A and the sheet material 31-1 at their joint surface and also the sheet material 31-1 and the valve closing plate 32 at their joint surface (FIG. 19B).

Figure 19C:
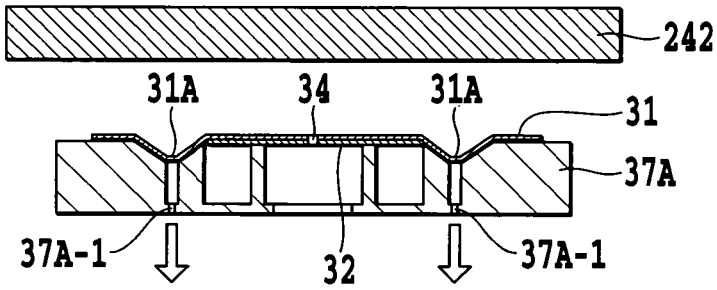

Next, as shown in FIG. 19C, the sheet material 31-1 is heated by a heater 242 and at the same time air is drawn out from a closed space formed between the enclosure part 37A and the sheet material 31-1 through discharge ports 37A-1. This causes the sheet material 31-1 to be deformed following the shape of the shaping portions 37A-2 provided in the enclosure part 37A, thus forming the undulated portion 31A in the sheet material 31-1. Now, the flexible sheet 31 is molded. Depending on the shape of the shaping portions 37A-2, any desired shape of the flexible sheet 31, like the one in the previous embodiment, can be formed.

Figure 19D:
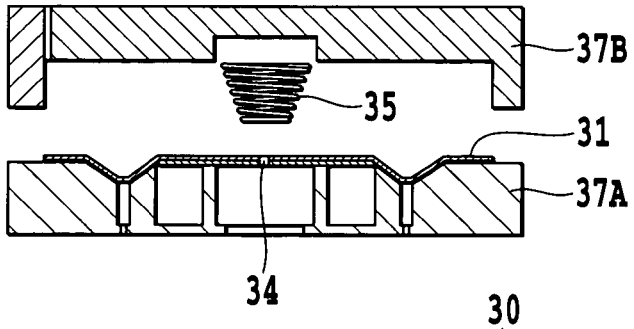
Figure 19E:
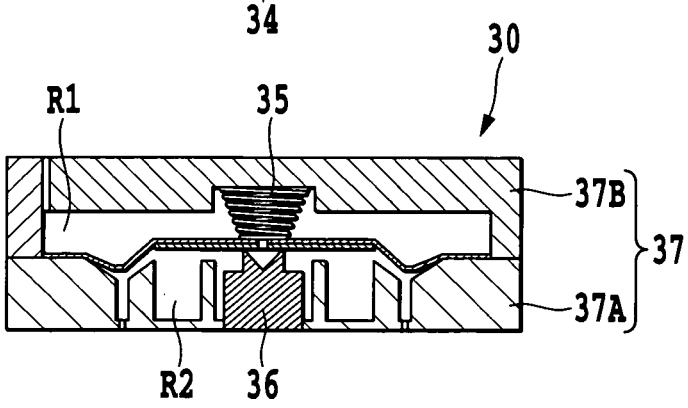

After this, as shown in FIG. 19D, the other enclosure part 37B having the valve restraining spring 35 as a biasing member and the enclosure part 37A attached with the flexible sheet 31 are positioned and joined together. Then, as shown in FIG. 19E, the seal member 36 is secured to the enclosure part 37A. Now, the one-way valve 30 is completed. The discharge ports 37A-1 are closed by using the enclosure 11 of the ink tank 10 or a closing member. The discharge ports 37A-1 can also be used as a part of the communication path 11B.

In this example, the undulated portion 31A protruding from the valve chamber R1 side toward the chamber R2 side is formed by pressing the sheet material 31-1 against the shaping portions 37A-2 provided on the chamber R2 side. Conversely, it is also possible to form the undulated portion 31A protruding from the chamber R2 side toward the valve chamber R1 side by pressing the sheet material 31-1 against the shaping portions provided on the valve chamber R1 side. In that case, the sheet material 31-1 is joined to the enclosure part 37B and then pressed against the shaping portions provided in the enclosure part 37A. With this process various shapes of flexible sheet 31, including one provided by the previous embodiment, can be formed.

In this example, the flexible sheet is manufactured by connecting a flat sheet material to a part of the enclosure and then molding it into a desired shape. This process allows the sheet material to be handled easily and requires no positioning of the sheet material. One drawback of this process is that the heating used in molding the sheet material applies heat not only to the sheet material but also to a part of the enclosure (container), as shown in FIG. 19C. Therefore, when the enclosure (container) and constitutional members of the one-way valve are small or thin, their possible thermal deformations must be considered.

(Variation of One-Way Valve)

Figure 20A:
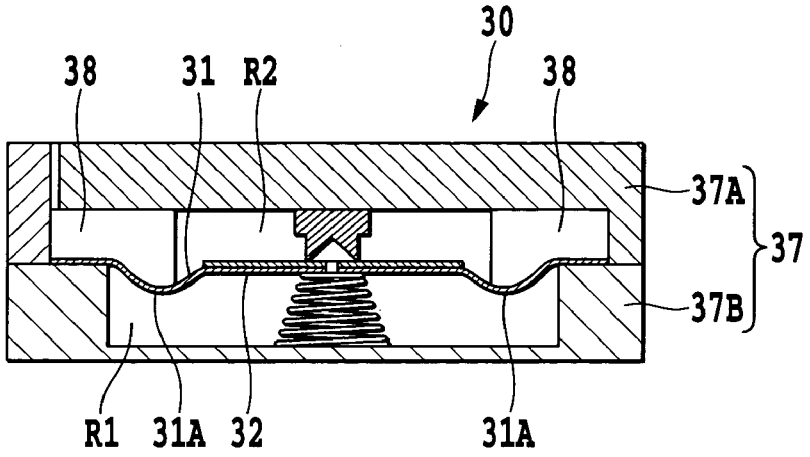
FIGS. 20A and 20B are cross-sectional views showing an operation of a further example of one-way valve installed in the liquid container of the present invention.
Figure 20B:
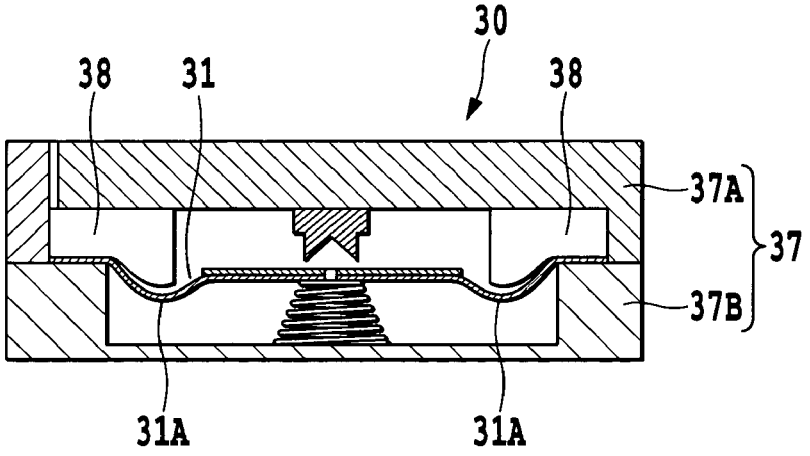

FIGS. 20A and 20B show a variation of the one-way valve 30. The construction of this example has a sheet restraining member 38 added in the one-way valve of FIG. 8A and FIG. 8B.

The sheet restraining member 38 restricts the shape of the movable area of the flexible sheet 31 to form the undulated portion 31A that satisfies the aforementioned requirements. The use of the sheet restraining member 38 can eliminate the drawbacks of the comparative examples such as shown in FIGS. 5A and 5B and FIGS. 6A and 6B, i.e., the formation of irregular folds in the movable area of the flexible sheet. In forming the undulated portion 31A, the sheet restraining member 38 may apply a deformation force to a flat, flexible sheet material or correct irregular folds such as shown in FIGS. 5A and 5B and FIGS. 6A and 6B. In this example, a plurality of the sheet restraining members 38 are arranged inside the enclosure part 37A along the circumference of the flexible sheet 31 at predetermined intervals.

Depending on a desired shape of the undulated portion 31A, the shape and set position of the sheet restraining member 38 can be chosen properly. That is, the sheet restraining member 38 need only be able to restrict a deformation direction of the movable area of the flexible sheet 31 so as to form the undulated portion 31A that meets the aforementioned requirements. However, care should be taken to ensure that the sheet restraining member 38 does not hinder the operation of the valve closing plate 32.

(Example Construction of Ink Jet Printing Apparatus)

Figure 21:
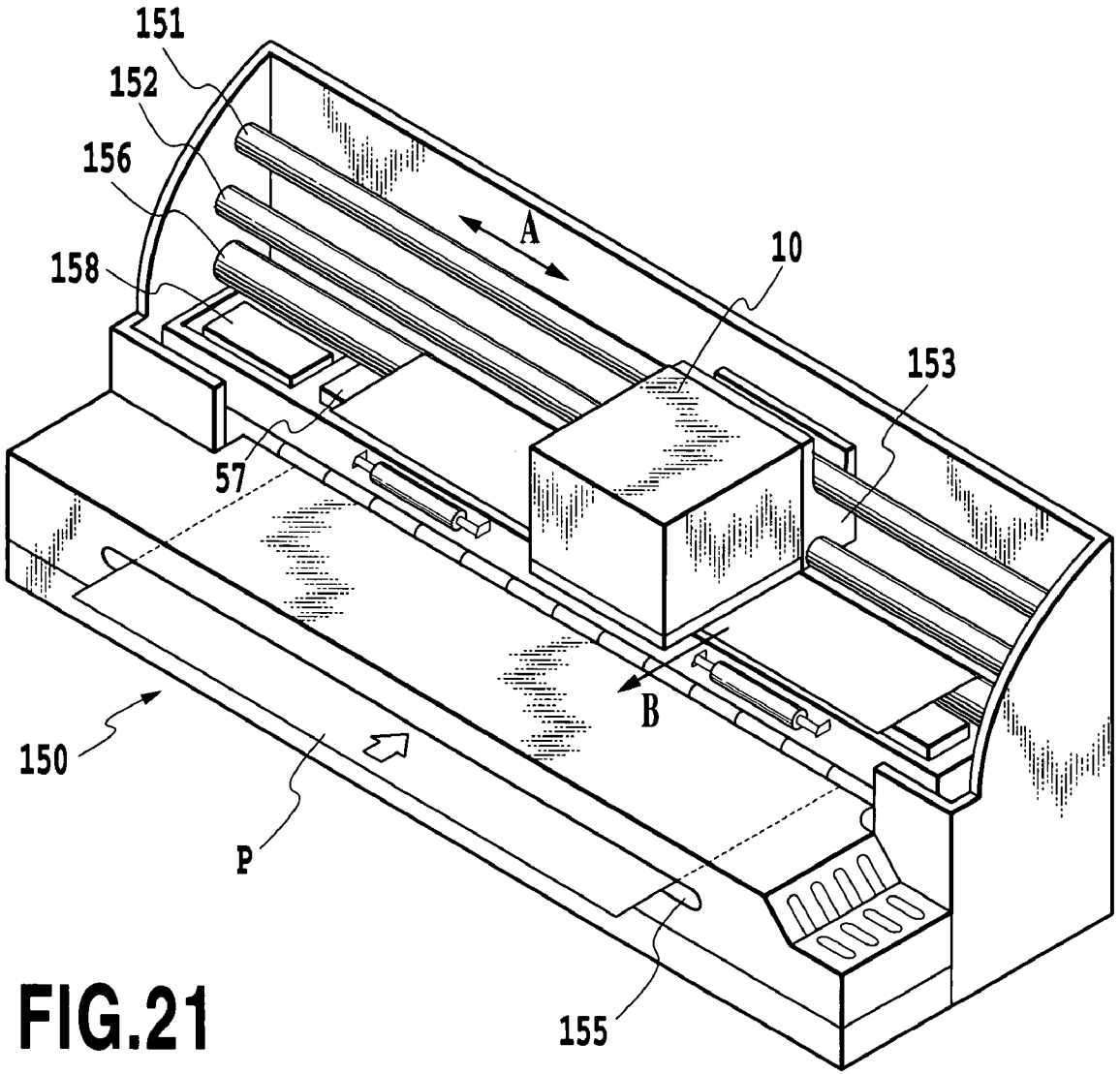
FIG. 21 is a perspective view of an essential portion of an ink jet printing apparatus to which this invention can be applied.

FIG. 21 illustrates an example construction of an ink jet printing apparatus as a liquid using device that can apply the present invention.

A printing apparatus 150 of this example is an ink jet printing apparatus of a serial scan type and has a carriage 153 movably guided on guide shafts 151, 152 so that it can be moved in a main scan direction indicated by arrow A. The carriage 153 is reciprocally moved in the main scan direction by a carriage motor and a drive force transmission mechanism such as a belt that transfers a drive force of the motor. The carriage 153 mounts a print head 20 (see FIG. 1) and an ink tank 10 for supplying ink to the print head 20. The print head 20 and the ink tank 10 are constructed in the similar manner to the above embodiment and may form an ink jet cartridge. Paper P as a print medium is inserted from an insertion opening 155 provided at the front of the apparatus. After its transport direction is reversed, the paper P is fed by a feed roller 156 in a subscan direction indicated by an arrow B. The printing apparatus-150 repeats a printing operation for ejecting ink toward a print area of the paper P on a platen 157 while the print head 20 is moved in the main scan direction and a feed operation for feeding the paper P in the subscan direction a distance corresponding to the printing width, thereby forming an image successively on the paper.

The print head 20 may be of a type that uses a thermal energy generated by an electrothermal transducer in ejecting ink. In that case, heat of the electrothermal transducer is used to cause a film boiling in ink to generate a bubble and thereby expel ink from a nozzle. The ink ejection method is not limited to this type that uses the electrothermal transducer and may use a piezoelectric element to eject ink.

At the left end of a movable range of the carriage 153 in FIG. 21 is installed a recovery unit (ejection performance recovery means) 158 which opposes a face of the print head 20 on the carriage 153 which is formed with nozzle openings. The recovery unit 158 has a cap capable of capping nozzle openings of the print head 20 and a suction pump for introducing a negative pressure into the cap. The recovery unit 158 performs a recovery operation (also referred to as a "suction-based recovery operation") by introducing a negative pressure into the cap that is hermetically enclosing the nozzle openings to suck out ink from the nozzles to maintain the ink ejection performance of the print head 20 in good condition. It is also possible to perform another type of recovery operation (also referred to as an "ejection-based recovery operation") in which the print head 20 ejects ink not contributing to the formation of image from the nozzles toward the inside of the cap.

In the printing apparatus of this example, the ink tank 10 mounted on the carriage 153 along with the print head 20 supplies ink to the print head 20.

(Other Embodiments)

While the above description concerns a case where the present invention is applied to an ink tank that supplies ink to a print head, the present invention can also be applied to an ink supply unit that supplies ink to a pen as a recording unit. The liquid that can apply the present invention is not limited to ink but, in the field of ink jet printing, may of course include a treatment liquid applied to a print medium.

In addition to various printing apparatus, the present invention can also be applied widely to devices that supply various kinds of liquids, such as drinking water and liquid artificial seasoning, and to devices in a medical field for supplying medicine.

Further, the present invention can be applied to various types of printing apparatus in addition to the serial scan type. For example, the present invention may be implemented as a so-called full line type printing apparatus which uses an elongate print head spanning a full length of the print area of the print medium.

Further, the liquid container of the present invention, when used as an ink tank for accommodating ink, may be fixedly or disconnectably connected with an ink jet print head to form an ink jet cartridge.

Further, the present invention can also be implemented as a variety of one-way valves using a flexible sheet. The flexible sheet is formed with an undulated portion whose undulated or folded shape is maintained in a movable area of the sheet. The flexible sheet is also provided with a characteristic so that its stress varies in a straight line or curve. This arrangement ensures that the one-way valve can stably operate with high sensitivity in response to minute pressure changes.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid container comprising:

an accommodation portion to define a liquid accommodation space;

a liquid supply portion to supply a liquid accommodated in the accommodation space to an outside;

a mechanism to maintain or expand a volume of the accommodation space; and a one-way valve to allow an introduction of a gas from the outside into the accommodation space and prevent the liquid and gas from flowing out of the accommodation space to the outside;

wherein the one-way valve includes: a flexible sheet formed of a resin material situated between a first chamber on the accommodation space side and a second chamber on the outside and having an area to secure a predetermined level of freedom of deflection; a plate-shaped valve closing member attached to the flexible sheet; and a valve mechanism to perform an open-close operation accompanied by a deflection of the flexible sheet, the degree of the flexible sheet deflection conforming to a pressure difference between the first chamber and the second chamber;

wherein an area of the flexible sheet around an outer periphery of said plate-shaped valve closing member is formed with a plurality of undulated portions whose undulated forms are maintained in at least an operation range of the valve mechanism; and wherein the plurality of undulated portions are formed in a plurality of positions substantially along a circumference of said plate-shaped valve closing member.

2. A liquid container according to claim 1, wherein the plurality of undulated portions rise or sink toward the first chamber side or the second chamber side.

3. A liquid container according to claim 1, wherein the valve mechanism includes a seal member provided at a predetermined position to oppose the valve closing member, and a biasing member urging the seal member and the valve closing member into mutual engagement;

wherein the valve closing member has an opening communicating the first chamber and the second chamber with each other;

wherein the seal member opens or closes the opening as the valve closing member moves accompanied by a deflection of the flexible sheet.

4. An ink tank accommodating ink as a liquid in the liquid container of claim 1.

5. An ink jet cartridge having the ink tank of claim 4 and an ink jet print head to eject ink.

6. An ink jet printing apparatus for printing an image by using the ink tank of claim 4 and an ink jet print head to eject ink and by ejecting ink supplied from the ink tank from the ink jet print head.

7. A one-way valve for allowing a fluid to move from a first chamber on one side of a path to a second chamber on the other side and blocking the fluid from moving from the second chamber to the first chamber, the one-way valve comprising:

a flexible sheet formed of a resin material situated between the first chamber and the second chamber and having an area to secure a predetermined level of freedom of deflection;

a plate-shaped valve closing member attached to the flexible sheet; and a valve mechanism to perform an open-close operation accompanied by a deflection of the flexible sheet, the degree of the flexible sheet deflection conforming to a pressure difference between the first chamber and the second chamber;

wherein an area of the flexible sheet around an outer periphery of said plate-shaped valve closing member is formed with a plurality of undulated portions whose undulated forms are maintained in at least an operation range of the valve mechanism; and wherein the plurality of undulated portions are formed in a plurality of positions substantially along a circumference of said plate-shaped valve closing member.

8. A method of manufacturing a liquid container, wherein the liquid container includes: an accommodation portion to define a liquid accommodation space; a liquid supply portion to supply a liquid accommodated in the accommodation space to an outside; a mechanism to maintain or expand a volume of the accommodation space; and a one-way valve to allow an introduction of a gas from the outside into the accommodation space and prevent the liquid and gas from flowing out of the accommodation space to the outside;

wherein the one-way valve includes: a flexible sheet formed of a resin material situated between a first chamber on the accommodation space side and a second chamber on the outside and having an area to secure a predetermined level of freedom of deflection; a plate-shaped valve closing member attached to the flexible sheet; and a valve mechanism to perform an open-close operation accompanied by a deflection of the flexible sheet, the degree of the flexible sheet deflection conforming to a pressure difference between the first chamber and the second chamber;

the method comprising:

a step of, before or after the flexible sheet is assembled into the one-way valve, forming in an area of the flexible sheet around an outer periphery of said plate-shaped valve closing member a plurality of undulated portions whose undulated forms are maintained in at least an operation range of the valve mechanism; and wherein the plurality of undulated portions are formed in a plurality of positions substantially along a circumference of said plate-shaped valve closing member.

9. A method of manufacturing a liquid container according to claim 8, further including:

a step of forming the plurality of undulated portions in the area of the flexible sheet before the flexible sheet is assembled into the one-way valve; and a step of, when the flexible sheet formed with the plurality of undulated portions is assembled into the one-way valve, setting an assembly attitude of the flexible sheet so that the undulated forms of the undulated portions can be maintained in at least a deflection range of the flexible sheet as the valve mechanism performs an open-close operation.

* * * * *

UNITED STATES PATENT AND TRADEMARK OFFICE

CERTIFICATE OF CORRECTION

PATENT NO. : 7,104,640 B2
APPLICATION NO. : 10/808477
DATED : September 12, 2006
INVENTOR(S) : Hideki Ogura et al.

It is certified that error appears in the above-identified patent and that said Letters Patent is hereby corrected as shown below:

COLUMN 2

Line 2, "cannot" should read --can--.

COLUMN 3

Line 9, "impacts" should read --impact--; and
Line 31, "inrush" should read --inrush of--.

COLUMN 22 after line 56

Claims 12 and 13, which are renumbered as Claims 10 and 11 below, were omitted and should be inserted, as follows:

--10. A method of manufacturing a liquid container according to claim 8, further including:

a step of assembling into the one-way valve the flexible sheet not formed with the plurality of undulated portions in the area of the flexible sheet; and a step of forming the plurality of undulated portions in the area of the flexible sheet after the flexible sheet is assembled into the one-way valve.

11. A method of manufacturing a liquid container according to claim 8, further including:

a step of, after preparing the liquid container provided with the one-way valve, injecting a liquid into the accommodation portion.--

Signed and Sealed this

Thirty-first Day of July, 2007

JON W. DUDAS
*Director of the United States Patent and Trademark Office*